US008039185B2

(12) United States Patent
Matsumoto et al.

(10) Patent No.: US 8,039,185 B2
(45) Date of Patent: Oct. 18, 2011

(54) TONER FOR DEVELOPING A LATENT ELECTROSTATIC IMAGE, METHOD FOR PRODUCING THE SAME, IMAGE-FORMING APPARATUS AND PROCESS CARTRIDGE USING THE SAME

(75) Inventors: Mitsuyo Matsumoto, Ibaraki (JP); Chiyoshi Nozaki, Otsu (JP); Tsuyoshi Nozaki, Ikeda (JP); Minoru Nakamura, Takarazuka (JP); Atsushi Yamamoto, Kawanishi (JP)

(73) Assignee: Ricoh Company, Ltd., Tokyo (JP)

( * ) Notice: Subject to any disclaimer, the term of this patent is extended or adjusted under 35 U.S.C. 154(b) by 884 days.

(21) Appl. No.: 11/687,431

(22) Filed: Mar. 16, 2007

(65) Prior Publication Data

US 2007/0218384 A1 Sep. 20, 2007

(30) Foreign Application Priority Data

Mar. 17, 2006 (JP) ..... 2006-075657

(51) Int. Cl.
*G03G 9/08* (2006.01)

(52) U.S. Cl. ..... 430/108.4; 430/108.8; 430/108.1; 430/109.4

(58) Field of Classification Search ..... 430/108.1, 430/108.4, 108.8, 109.4; 399/232
See application file for complete search history.

(56) References Cited

U.S. PATENT DOCUMENTS

| | | | | |
|---|---|---|---|---|
| 2004/0229147 | A1* | 11/2004 | Higuchi et al. | 430/110.3 |
| 2006/0040194 | A1* | 2/2006 | Sugiura et al. | 430/108.4 |
| 2006/0056888 | A1* | 3/2006 | Sugiyama et al. | 399/328 |
| 2006/0204882 | A1 | 9/2006 | Nozaki et al. | |
| 2006/0210902 | A1 | 9/2006 | Nakamura et al. | |
| 2006/0275686 | A1 | 12/2006 | Kadota et al. | |

FOREIGN PATENT DOCUMENTS

| | | |
|---|---|---|
| JP | 2663016 | 6/1997 |
| JP | 2000-214638 | 8/2000 |
| JP | 2002-6541 | 1/2002 |
| JP | 2004-226946 | 8/2004 |
| JP | 2004-246345 | 9/2004 |
| JP | 2004-258625 | 9/2004 |
| JP | 2005-10208 | 1/2005 |
| JP | 2005-31159 | 2/2005 |

(Continued)

OTHER PUBLICATIONS

Diamond, Arthur S & David Weiss (eds.) Handbook of Imaging Materials, 2nd ed. New York: Marcel-Dekker, Inc. (Nov. 2001) pp. 145-168.*

(Continued)

*Primary Examiner* — Christopher Rodee
(74) *Attorney, Agent, or Firm* — Oblon, Spivak, McClelland, Maier & Neustadt, L.L.P.

(57) ABSTRACT

To provide a toner for developing a latent electrostatic image comprising at least a colorant, a wax, and a binder resin, wherein Iwax (s) is a value measured by FTIR-ATR Spectroscopy before heating a mirror-surfaced pellet formed by compressing and molding the toner, and Iwax (t) is a value measured by FTIR-ATR Spectroscopy after heating the pellet at a surface temperature thereof of 130° C. for 1 minute satisfy Formulae (1), (2), (3), and (4), $$Iwax\ (t) \geqq 0.2*100/[T\tfrac{1}{2}(^\circ C.)] \quad \text{Formula (1)}$$

$$Iwax\ (s) \leqq 0.26 \quad \text{Formula (2)}$$

$$Iwax\ (t) \leqq 0.50 \quad \text{Formula (3)}$$

$$Iwax\ (t) > Iwax\ (s) \quad \text{Formula (4)}$$

wherein both Iwax(s) and Iwax(t) are obtained by a formula: absorbance derived from the wax (2850 $cm^{-1}$)/absorbance derived from the binder resin (828 $cm^{-1}$).

11 Claims, 3 Drawing Sheets

FOREIGN PATENT DOCUMENTS

| | | |
|---|---|---|
| JP | 2005-84407 | 3/2005 |
| JP | 2005-266607 | 9/2005 |
| JP | 2005-301261 | 10/2005 |

OTHER PUBLICATIONS

English language machine translation of JP 2005-266607 (Sep. 2005).*
U.S. Appl. No. 12/043,633, filed Mar. 6, 2008, Nakamura, et al.
U.S. Appl. NO. 12/046,869, filed Mar. 12, 2008, Nozaki, et al.
U.S. Appl. No. 12/017,853, filed Jan. 22, 2008, Masumoto, et al.*
U.S. Appl. No. 12/026,057, filed Feb. 5, 2008, Nozaki, et al.*
U.S. Appl. No. 12/046,784, filed Mar. 12, 2008, Nozaki, et al.*
U.S. Appl. No. 12/046,866, filed Mar. 12, 2008, Matsumoto, et al.*
U.S. Appl. No. 12/048,689, filed Mar. 14, 2008, Kadota, et al.*
U.S. Appl. No. 12/049,719, filed Mar. 17, 2008, Yamamoto, et al.*
U.S. Appl. No. 12/050,663, filed Mar. 18, 2008, Izutani, et al.*
U.S. Appl. No. 12/050,963, filed Mar. 19, 2008, Ishikawa et al.*

* cited by examiner

TONER FOR DEVELOPING A LATENT ELECTROSTATIC IMAGE, METHOD FOR PRODUCING THE SAME, IMAGE-FORMING APPARATUS AND PROCESS CARTRIDGE USING THE SAME

BACKGROUND OF THE INVENTION

1. Field of the Invention

The present invention relates to a toner for developing a latent electrostatic image, which controls the dispersion state of wax near the toner surface to suppress sticking and be excellent in fixing property, and the present invention also relates to a method for producing the toner, an image-forming apparatus and a process cartridge using the toner.

2. Description of the Related Art

In an electrophotographic image forming apparatus, a toner image is formed on a photoconductor by the following steps: charging the surface of the photoconductor which is an image bearing member by discharging, exposing the charged surface of the photoconductor to form a latent electrostatic image, developing the latent electrostatic image by supplying a toner having an opposite polarity to the latent electrostatic image which is formed on the surface of the photoconductor. The toner image formed on the photoconductor is transferred to an intermediate transferring medium, and then transferred from the intermediate transferring medium to a recording member such as a paper, or otherwise, transferred directly from the photoconductor to the recording member. Then, the transferred toner image is fixed on the recording member by heating and pressing.

In the above steps, the recording member is sandwiched between a pair of roller- or belt-shaped fixing members each having a heater inside thereof so as to fix the toner image on the recording member by heat-melting and pressing the toner. When the heating temperature is too high, the toner melts excessively and the toner is fused on the fixing member, namely hot offset is occurred. When the heating temperature is too low, the toner does not melt enough, and the fixing property is insufficient. From the viewpoint of saving energy and downsizing an image forming apparatus, the toner having higher hot-offset generating temperature, or hot-offset resistance, and lower fixing temperature, or low-temperature fixing property are required.

Particularly, in a full-color copier and a full-color printer, a toner has to have a low-melting viscosity, as the glossiness and color mixing property of an image is required. Thus, a polyester toner binder having sharp melt property is used. Because hot offset is likely to be occurred in this kind of a toner, a silicone-oil or the like is coated on the fixing member in the conventional full-color apparatus. However, the configuration of such the apparatus is complicated and the size thereof becomes large, because an oil tank, and a device for coating oil are required in order to coat the silicone oil on the fixing member. In addition, maintenance is needed periodically due to the degradation of the fixing member. Moreover, it is unavoidable that the oil adheres to a copy paper, a film for OHP, i.e. Overhead Projector, or the like. Especially when a printing is performed on an OHP film, the color tone may be degraded by the oil adhesion.

Therefore, the method of adding a wax to a toner is generally used to prevent adhesion of the toner without coating oil on the fixing member. However, the effect of releasing ability is greatly influenced by the dispersion state of the wax in the toner binder.

Japanese Patent (JP-B) No. 2663016 discloses that a low melting wax which cannot be used in a pulverization toner is contained in a toner which is produced by suspending and polymerizing a substance having a polar group and a polymerizable monomer having a releasing agent in water. The nonpolar component such as a wax does not exist near the surface of toner particle on the contrary to the polar component, and forms a pseudocapsule structure which is covered with the polar component forming the surface. However, in this technology, the wax is strongly retained inside of the toner, so that wax exudation after heating is inhibited. Thus, the wax insufficiently exudes, and then the releasing property is not sufficiently exhibited.

Japanese Patent Application Laid-Open (JP-A) No. 2002-6541 discloses that a toner consisting of toner particles each including a wax inside, and the wax locally exists near the surface of the toner particle. However, in this technology, the amount of the wax based on the total amount of the toner is not described. In only one example described therein, the amount of the wax based on the total amount of the toner particles is less than 1%. The wax exudes on the surface of a fixing member to prevent the toner adhesion thereto when fixing, however, the releasing effect by the wax is insufficient due to the small amount of the wax, and then the hot-offset margin may be lost.

JP-A No. 2004-246345 discloses that the dispersion state of the wax near the toner surface is controlled to improve the hot-offset resistance, thereby producing a toner having excellent fixing property, and to improve blocking resistance in an electrophotographic image forming, thereby having excellent storage property for a long time. The amount of the wax in the toner is determined by FTIR-ATR, i.e. Fourier Transform Infra-Red attenuated total reflection Spectroscopy. However, the amount of the wax on the surface of the toner after heating is not described.

JP-A No. 2004-258625 discloses that an image forming method using the combination of a developer, in which the dynamic friction coefficient of the toner influenced by the wax on the toner surface is adjusted to minimize the biased abrasion in a photoconductor over time, and a process which is optimal for the developer in an image forming system which has been achieved lower cost, and smaller in footprint. JP-A No. 2004-258625 also discloses the toner containing at least a binder resin and a wax, and having the dynamic friction coefficient of 0.15 to 0.45. However, the dispersion state of the wax near the toner surface is not described therein.

BRIEF SUMMARY OF THE INVENTION

The object of the present invention is to provide a toner containing at least a colorant, a wax, and a binder, which controls the dispersion state of the wax near the toner surface to suppress sticking and being excellent in fixing property, and the present invention also relates a method for producing the toner, an image-forming apparatus and a process cartridge using the toner.

The present inventors have diligently studied, and found that the above-mentioned problems are solved by the invention described below.

The above-mentioned problems are solved by the following <1> to <20>.

<1> A toner for developing a latent electrostatic image containing at least a colorant, a wax and a binder resin, wherein Iwax (s) which is a value measured by FTIR-ATR Spectroscopy before heating a mirror-surfaced pellet formed by compressing and molding the toner, and Iwax (t) which is a value measured by FTIR-ATR Spectroscopy after heating the pellet at a surface temperature thereof of 130° C. for 1 minute satisfy Formulae (1), (2), (3), and (4), and a quantity of heat ΔH associated with melting the wax in the toner measured by a differential scanning calorimeter (DSC) is expressed by Formula (5), $$Iwax\ (t) \geqq 0.2*100/[T½(°\ C.)] \quad \text{Formula (1)}$$

$$Iwax\ (s) \leqq 0.26 \quad \text{Formula (2)}$$

$$Iwax\ (t) \leqq 0.50 \quad \text{Formula (3)}$$

$$Iwax\ (t) > Iwax\ (s) \quad \text{Formula (4)}$$

$$3.0\ mJ/mg \leqq \Delta H \leqq 14.0\ mJ/mg \quad \text{Formula (5)}$$

wherein Iwax (s) represents a value of before heating the pellet, which is obtained by a formula: absorbance derived from the wax (2850 $cm^{-1}$)/absorbance derived from the binder resin (828 $cm^{-1}$), and Iwax (t) represents a value of after heating the pellet at a surface temperature thereof of 130° C. for 1 minute, which is obtained by a formula: absorbance derived from the wax (2850 $cm^{-1}$)/absorbance derived from the binder resin (828 $cm^{-1}$). Note that, in Formula (1), T½(° C.) represents a T½ flow beginning temperature. The T½ flow beginning temperature is measured as follows: a Flowtester is an apparatus for evaluating the thermal property of a sample by heating a heating body at a constant heating rate, pressurizing the sample, and then measuring a descent distance of a plunger. The T½ flow beginning temperature is measured by a Flowtester CFT-500 by SHIMADZU CORPORATION. 1 g of the toner is placed in a pump and a piston is inserted therein and then pressed at 4 kN to produce a die having a diameter of 0.5 mm. The measurement is performed at a load of 30 kg, and a rate of temperature rise of 3° C./min. The T½ flow beginning temperature is defined at the temperature where the movement amount of the plunger is decreased by half.

<2> The toner for developing a latent electrostatic image according to <1>, wherein the binder resin is a polyester resin having a glass transition temperature of 40° C. to 75° C.

<3> The toner for developing a latent electrostatic image according to any of <1> to <2>, wherein the binder resin contains a polyester resin which is elongated by a urethane bonding and/or a urea bonding.

<4> The toner for developing a latent electrostatic image according to <3>, wherein the polyester resin contains a modified polyester resin formed by a reaction between a polyester prepolymer having an isocyanate group at both or either terminals thereof, and amines.

<5> The toner for developing a latent electrostatic image according to any of <1> to <4>, wherein the toner has a circularity of 0.95 to less than 0.99, and a volume-average particle diameter of 4 μm to less than 8 μm.

<6> The toner for developing a latent electrostatic image according to any of <1> to <5>, wherein the toner is obtained by forming toner particles in an aqueous medium, and removing an organic solvent after the toner particles.

<7> The toner for developing a latent electrostatic image according to any of <1> to <6>, wherein the toner is obtained by forming toner particles in an aqueous medium, washing the toner particles in an aqueous medium for washing, and drying the toner particles.

<8> The toner for developing a latent electrostatic image according to any of <1> to <7>, wherein the wax contains at least one selected from a paraffin wax, synthetic ester, polyolefin, a carnauba wax and a rice wax.

<9> The toner for developing a latent electrostatic image according to any of <1> to <8>, further contains a charge control agent.

<10> The toner for developing a latent electrostatic image according to any of <1> to <9>, wherein the toner is a nonmagnetic one-component toner.

<11> A toner for developing a latent electrostatic image containing at least a colorant, a wax and a binder resin, wherein Iwax (s) which is a value measured by FTIR-ATR Spectroscopy before heating a mirror-surfaced pellet formed by compressing and molding the toner, and Iwax (t) which is a value measured by FTIR-ATR Spectroscopy after heating the pellet at a surface temperature thereof of 130° C. for 1 minute satisfy Formulae (1), (2), (3), and (4).

$$Iwax\ (t) \geqq 0.2*100/[T½(°\ C.)] \quad \text{Formula (1)}$$

$$Iwax\ (s) \leqq 0.26 \quad \text{Formula (2)}$$

$$Iwax\ (t) \leqq 0.50 \quad \text{Formula (3)}$$

$$Iwax\ (t) > Iwax\ (s) \quad \text{Formula (4)}$$

wherein Iwax (s) represents a value of before heating the pellet, which is obtained by a formula: absorbance derived from the wax (2850 $cm^{-1}$)/absorbance derived from the binder resin (828 $cm^{-1}$), and Iwax (t) represents a value of after heating the pellet at a surface temperature thereof of 130° C. for 1 minute, which is obtained by a formula: absorbance derived from the wax (2850 $cm^{-1}$)/absorbance derived from the binder resin (828 $cm^{-1}$).

<12> An image forming apparatus containing a photoconductor, a charging unit configured to charge the photoconductor, an exposing unit configured to expose the photoconductor to form a latent electrostatic image, and a developing unit housing a toner therein, configured to develop the latent electrostatic image using the toner to form a toner image, wherein the toner contains at least a colorant, a wax, and a binder resin, wherein Iwax (s) which is a value measured by FTIR-ATR Spectroscopy before heating a mirror-surfaced pellet formed by compressing and molding the toner, and Iwax (t) which is a value measured by FTIR-ATR Spectroscopy after heating the pellet at the surface temperature of 130° C. for 1 minute satisfy Formulae (1), (2), (3), and (4), and the quantity of heat ΔH associated with melting the wax in the toner measured by a differential scanning calorimeter (DSC) is expressed by Formula (5), $$Iwax\ (t) \geqq 0.2*100/[T½(°\ C.)] \quad \text{Formula (1)}$$

$$Iwax\ (s) \leqq 0.26 \quad \text{Formula (2)}$$

$$Iwax\ (t) \leqq 0.50 \quad \text{Formula (3)}$$

$$Iwax\ (t) > Iwax\ (s) \quad \text{Formula (4)}$$

$$3.0\ mJ/mg \leqq \Delta H \leqq 14.0\ mJ/mg \quad \text{Formula (5)}$$

wherein Iwax (s) represents a value of before heating the pellet, which is obtained by a formula: absorbance derived from the wax (2850 $cm^{-1}$)/absorbance derived from the binder resin (828 $cm^{-1}$), and Iwax (t) represents a value of after heating the pellet at a surface temperature thereof of 130° C. for 1 minute, which is obtained by a formula: absorbance derived from the wax (2850 $cm^{-1}$)/absorbance derived from the binder resin (828 $cm^{-1}$), wherein the toner is a nonmagnetic one-component toner.

<13> The image forming apparatus according to <12>, wherein the image forming apparatus is configured to form a multicolor image.

<14> The image forming apparatus according to any of <12> to <13>, wherein the image forming apparatus contains an intermediate transferring unit utilizing an endless belt.

<15> The image forming apparatus according to any of <12> to <14>, wherein the image forming apparatus is free from a blade as a cleaning unit for cleaning a residual toner on the photoconductor and/or an intermediate transferring unit disposed in the image forming apparatus.

<16> The image forming apparatus according to any of <12> to <15>, wherein the image forming apparatus contains a blade cleaning unit.

<17> The image forming apparatus according to any of <12> to <16>, wherein the image forming apparatus contains a fixing unit containing a roller equipped with a heating device.

<18> The image forming apparatus according to any of <12> to <16>, wherein the image forming apparatus contains a fixing unit containing a belt equipped with a heating device.

<19> The image forming apparatus according to any of <14> to <18>, wherein the image forming apparatus contains an oilless fixing unit containing a fixing member which functions without coating oil thereon.

<20> A process cartridge containing a photoconductor, and at least one unit selected from a charging unit configured to charge the photoconductor, an exposing unit configured to expose the photoconductor to form a latent electrostatic image, a developing unit housing a toner therein, configured to develop the latent electrostatic image using the toner to form a toner image, and a cleaning unit containing a blade, configured to clean a residual toner on a surface of the photoconductor with the blade after transferring the toner image therefrom, wherein the photoconductor and the at least one unit are integrally arranged in the process cartridge, wherein the process cartridge is detachably attached to an image-forming apparatus, wherein the toner contains at least a colorant, a wax, and a binder resin, wherein Iwax (s) which is a value measured by FTIR-ATR Spectroscopy before heating a mirror-surfaced pellet formed by compressing and molding the toner, and Iwax (t) which is a value measured by FTIR-ATR Spectroscopy after heating the pellet at a surface temperature thereof of 130° C. for 1 minute satisfy Formulae (1), (2), (3), and (4), and a quantity of heat ΔH associated with melting the wax in the toner measured by a differential scanning calorimeter (DSC) is expressed by Formula (5), $$I\text{wax}(t) \geqq 0.2*100/[T\tfrac{1}{2}(^\circ\text{C.})] \quad \text{Formula (1)}$$

$$I\text{wax}(s) \leqq 0.26 \quad \text{Formula (2)}$$

$$I\text{wax}(t) \leqq 0.50 \quad \text{Formula (3)}$$

$$I\text{wax}(t) > I\text{wax}(s) \quad \text{Formula (4)}$$

$$3.0\ \text{mJ/mg} \leqq \Delta H \leqq 14.0\ \text{mJ/mg} \quad \text{Formula (5)}$$

wherein Iwax (s) represents a value of before heating the pellet, which is obtained by a formula: absorbance derived from the wax (2850 $cm^{-1}$)/absorbance derived from the binder resin (828 $cm^{-1}$), and Iwax (t) represents a value of after heating the pellet at a surface temperature thereof of 130° C. for 1 minute, which is obtained by a formula: absorbance derived from the wax (2850 $cm^{-1}$)/absorbance derived from the binder resin (828 $cm^{-1}$).

The present invention provides a toner containing at least a colorant, a wax, and a binder resin, wherein Iwax (s) which is the value measured by FTIR-ATR Spectroscopy before heating a mirror-surfaced pellet formed by compressing and molding the toner, and Iwax (t) which is the value measured by FTIR-ATR Spectroscopy after heating the pellet at the surface temperature thereof of 130° C. for 1 minute satisfy Formulae (1), (2), (3), and (4), and the quantity of heat ΔH associated with melting the wax in the toner measured by a differential scanning calorimeter (DSC) is expressed by Formula (5). Thus, the dispersion state of the wax near the toner surface is controlled to suppress the sticking and to be excellent in fixing property, and a high quality image can be provided.

DETAILED DESCRIPTION OF THE INVENTION

Figure 1:
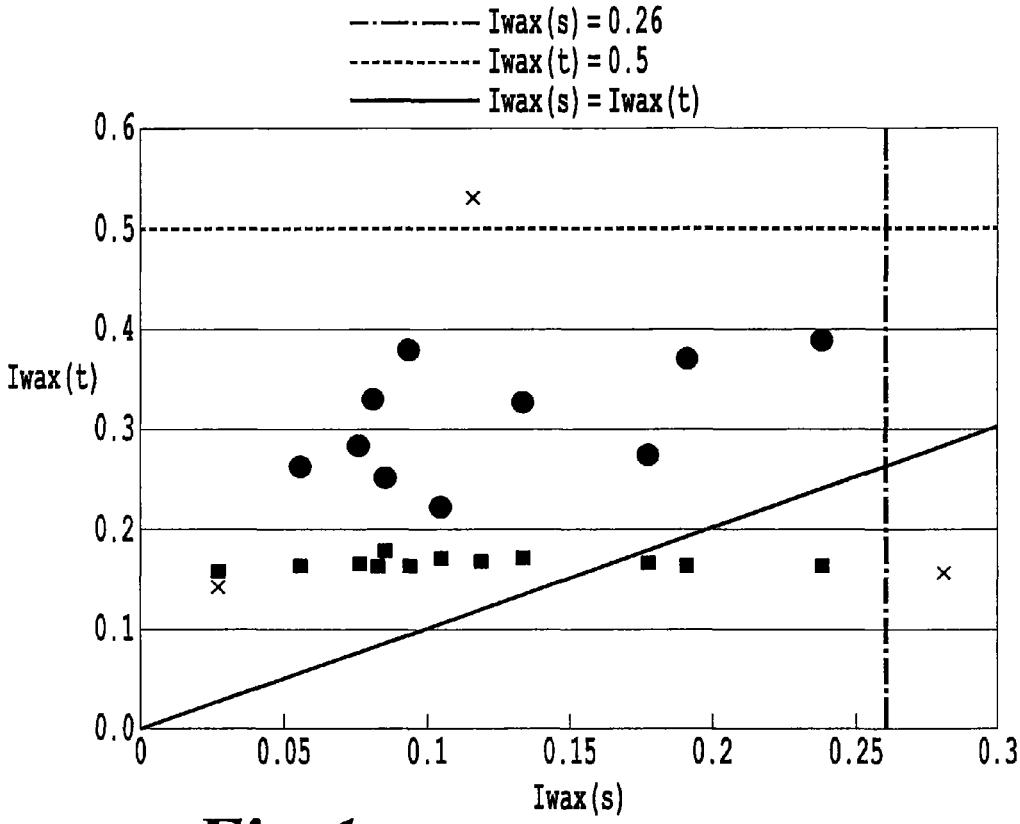
FIG. 1 shows an example of a conceptual diagram which satisfies the toner condition of the present invention expressed by Formulae (1) to (4).

The present invention will be explained hereinafter with specific examples.

The toner of the present invention contains at least a colorant, a wax as a releasing agent and a binder resin, wherein Iwax (s) which is the value measured by FTIR-ATR, i.e. Fourier Transform Infra-Red attenuated total reflection Spectroscopy before heating a mirror-surfaced pellet formed by compressing and molding the toner, and Iwax (t) which is the value measured by FTIR-ATR Spectroscopy after heating the pellet at the surface temperature of 130° C. for 1 minute satisfy Formulae (1), (2), (3), and (4), and the quantity of heat ΔH associated with melting the wax in the toner measured by DSC, i.e. a differential scanning calorimeter is expressed by Formula (5).

$$I\text{wax}(t) \geqq 0.2*100/[T\tfrac{1}{2}(^\circ\text{C.})] \quad \text{Formula (1)}$$

$$I\text{wax}(s) \leqq 0.26 \quad \text{Formula (2)}$$

$$I\text{wax}(t) \leqq 0.50 \quad \text{Formula (3)}$$

$$I\text{wax}(t) > I\text{wax}(s) \quad \text{Formula (4)}$$

$$3.0\ \text{mJ/mg} \leqq \Delta H \leqq 14.0\ \text{mJ/mg} \quad \text{Formula (5)}$$

wherein Iwax (s) represents a value of before heating the pellet, which is obtained by a formula: absorbance derived from the wax (2850 $cm^{-1}$)/absorbance derived from the binder resin (828 $cm^{-1}$), and Iwax (t) represents a value of after heating the pellet at the surface temperature of 130° C. for 1 minute, which is obtained by a formula: absorbance derived from a wax (2850 $cm^{-1}$)/absorbance derived from a binder resin (828 $cm^{-1}$).

The Formulae (1), (2), (3), and (4) of the subjective toner are obtained using FTIR-ATR, i.e. Fourier Transform Infra-Red attenuated total reflection Spectroscopy. Specifically, Formulae (1), (2), (3), and (4) are obtained on the basis of the peak intensity ratio of the wax (2850 $cm^{-1}$) to the binder resin (828 $cm^{-1}$) before heating the pellet, i.e. Iwax (s), and the peak intensity ratio of the wax (2850 $cm^{-1}$) to the binder resin (828 $cm^{-1}$) after heating the pellet, i.e. Iwax (t) which is related to the amount of the wax on the toner surface when a mirror-surfaced pellet formed by compressing and molding the toner is heated at the surface temperature of 130° C. for 1 minute. Formulae (1), (2), (3), and (4) are obtained using FTIR-ATR Spectroscopy by means of the following measuring device, and at the following conditions.

The quantity of heat ΔH (mJ/mg) associated with melting the wax in the toner is measured by a differential scanning calorimeter (DSC), and the quantity of heat expressed by Formula (5) is obtained by the following measuring device and at the following conditions.

Measuring device: a differential scanning calorimeter (for example, DSC-6220R the one manufactured by Seiko Instruments Inc.)

Measuring environment: heating from a room temperature to 150° C. at the temperature rise rate of 10° C./min, followed by leaving to stand at 150° C. for 10 mins., and cooling down to the room temperature, then leaving to stand for 10 mins, and again heating up to 150° C. at the temperature rise rate of 10° C./min, and then finally glass transition is completed. After the completion of the glass transition, the quantity of heat expressed by Formula (5) is obtained from the area surrounded with a tangent line above the DSC line in which the change of DSC becomes 0±20, the point of intersection between the tangent line and a transition DSC curve, and the transition DSC curve.

Iwax(s) and Iwax(t) of plurality of toners shown in Table 1 are shown in FIG. 1. In the case where Iwax(s) and Iwax(t) of each toners satisfy the Formulae (1), (2), (3), and (4), such the toners are plotted within a region surrounded by the lines showing the maximum and/or minimum values satisfying the Formulae (1), (2), (3), and (4).

3 g of a sample of the toner particles is shaped to pellets by pressing the sample with a load of 6t for one minute using an automatic pelletizing device, Type M No. 50 BRP-E (by Maekawa Testing Machine Co. Ltd.), thereby yielded pellets having a diameter of 40 mm and an about 2 mm thick.

Therefore, a toner of the present invention contains a wax dispersed in toner particles in which the Formulae (1), (2), (3), and (4) are satisfied, and the quantity of heat ΔH associated with melting the wax in the toner measured by a differential scanning calorimeter (DSC) is expressed by Formula (5). Thus, the dispersion state of the wax near the toner surface is controlled to suppress the sticking and to be excellent in fixing property, and a high quality image can be provided.

As shown in FIG. 1, if Iwax (t) is smaller than the specified value of Formula (1), the wax does not sufficiently exude on the toner surface to separate and the releasing ability may not be effective. If Iwax (s) is larger than the specified value of Formula (2), the sticking occurs to be cause the fixing failure of the toner. If Iwax (t) is larger than the specified value of Formula (3), the fixing strength is not enough to prevent the fixing failure of the toner. Thus, if Iwax (s) and Iwax (t) do not satisfy formulae (1), (2), (3), and (4), the dispersion state of the wax near the toner surface is not well, and the fixing failure of the toner occurs, and resulted in an image with low image quality.

The rapid exudation of the wax on the toner surface at the time of fixing leads to the stable fixing of the toner, and therefore a high quality image can be provided.

Examples of the method for producing the toner include a dissolution-suspension method which is disclosed in "Journal of the Imaging Society of Japan, Vol. 43 No. 1, 2004", and a new polymerization method in which at least a modified polyester prepolymer and a material containing a toner composition is dissolved and dispersed in an organic solvent, and the solution or the dispersion is cross-linked and/or elongated in an aqueous medium, and then the solvent is removed from the obtained dispersion to yield a toner. The method for producing the toner is preferably a method in which at least a polyester, which may contain a modified polyester prepolymer as a binder resin, and a material containing a toner composition and/or a radical generator are dissolved and dispersed in an organic solvent, the solution or dispersion thereof, which are also referred to as an oil phase, is emulsified or dispersed in the presence of a radical generator in an aqueous medium, and the solvent is removed therefrom, thereby obtaining a toner. The method for producing the toner will be precisely explained hereinbelow.

I. Material for Oil Phase 1-1 Polyester

The binder resin of the present invention contains polyester which does not contain a vinyl polymer group. The glass transition temperature (Tg) of the polyester is preferably 40° C. to 75° C. When Tg is 40° C. or higher, a sufficient heat-resistant storage stability can be attained. However, when it is higher than 75° C., the low-temperature fixing property of the toner is insufficient. Examples of such polyester include the known polyester, such as an unmodified polyester obtained from the reaction of polycarboxylic acid and polyol, and so-called modified polyester obtained from a polyester prepolymers having an isocyanate group. These may be used alone or in combination.

I-2 Modified Polyester

In the present invention, a polyester prepolymer having an isocyanate group (A) may be used for forming a modified polyester (i). The polyester prepolymer (A) is formed from a reaction between polyester having an active hydrogen group formed by polycondensation between polyol (1) and a polycarboxylic acid (2), and a further reaction with polyisocyanate (3). Examples of active hydrogen groups contained in the polyester include a hydroxyl group such as an alcoholic hydroxyl group and a phenolic hydroxyl group; an amino group; a carboxylic group; and a mercapto group. Among these, the alcoholic hydroxyl group is preferable.

I-2-1 Polyol

Examples of the polyol (1) include alkylene glycols such as ethylene glycol, 1,2-propylene glycol, 1,3-propylene glycol, 1,4-butanediol and 1,6-hexanediol; alkylene ether glycols such as diethylene glycol, triethylene glycol, dipropylene glycol, polyethylene glycol, polypropylene glycol and polytetramethylene ether glycol; alicyclic diols such as 1,4-cyclohexane dimethanol and hydrogenated bisphenol A; bisphenols such as bisphenol A, bisphenol F, bisphenol S, and 4,4'-dihydroxybiphenyls such as 3,3'-difluoro-4,4'-dihydroxybiphenyl; bis(hydroxyphenyl)alkanes such as bis(3-fluoro-4-hydroxyphenyl)methane, 1-phenyl-1,1-bis(3-fluoro-4-hydroxyphenyl)ethane, 2,2-bis (3-fluoro-4-hydroxyphenyl) propane, 2,2-bis(3,5-difluoro-4-hydroxyphenyl)propane (also known as tetrafluorobisphenol A), 2,2-bis(3-hydroxyphenyl)-1,1,1,3,3,3-hexafluoro propanes; bis(4-hydroxyphenyl) ethers such as bis(3-fluoro-4-hydroxyphenyl) ether; an adduct of an alkylene oxide of the aliphatic diol such as ethylene oxide, propylene oxide and butylene oxide; and an adduct of the bisphenols of an alkylene oxide such as ethylene oxide, propylene oxide and butylene oxide.

Among these, the alkylene glycol having 2 to 12 carbon atoms, and the alkylene oxide adduct of the bisphenols are preferable. The alkylene oxide adduct of the bisphenols, and the combination of the alkylene oxide adduct of the bisphenols and the alkylene glycol having 2 to 12 carbon atoms are particularly preferable.

In addition, examples thereof include polyvalent aliphatic alcohols having three to eight valences or more such as glycerin, trimethylolethane, trimethylolpropane, pentaerythritol and sorbitol; phenols having three or more valences such as trisphenol PA, phenol novolac and cresol novolac; and an alkylene oxide adduct of the polyphenols having three or more valences.

The polyols can be used alone or in combination, and are not limited to the above examples.

1-2-2 Polycarboxylic Acid

Examples of the polycarboxylic acid (2) include alkylene dicarboxylic acids such as succinic acid, adipic acid and sebacic acid; alkenylene dicarboxylic acids such as maleic acid and fumaric acid; and aromatic dicarboxylic acids such as phthalic acid, isophthalic acid, terephthalic acid and naphthalenedicaroboxylic acid, 3-fluoro isophthalate, 2-fluoro isophthalate, 2-fluoro terephthalate, 2,4,5,6-tetrafluoro isophthalate, 2,3,5,6-tetrafluoro terephthalate, 5-trifluoromethyl isophthalate, 2,2-bis(4-carboxyphenyl)hexafluoropropane, 2,2-bis(3-carboxyphenyl) hexafluoropropane, 2,2'-bis (trifluoromethyl)-4,4'-biphenyldicarboxylate, 3,3'-bis (trifluoromethyl)-4,4'-biphenyldicarboxylate, 2,2'-bis (trifluoromethyl)-3,3'-biphenyldicarboxylate, and hexafluoroisopropylidene diphthalic anhydride. Among these, the alkenylene dicarboxylic acid having 4 to 20 carbon atoms and the aromatic dicarboxylic acid having 8 to 20 carbon atoms are preferable. Examples of the polycarboxylic acids with three or more valences include an aromatic polycarboxylic acid having 9 to 20 carbon atoms of such as trimellitic acid and pyromellitic acid. An anhydrides of the above-mentioned compounds or lower alkylesters such as methyl ester, ethyl ester and isopropyl ester may be used to react with the polyol (1).

Polycarboxylic acids can be used alone or in combination, and are not limited to the above examples.

I-2-3 Ratio of Polyol to Polycarboxylic Acid

The ratio of the polyol (1) to the polycarboxylic acid (2) is, defined to be an equivalent ratio [OH]/[COOH] of a hydroxyl group [OH] to a carboxyl group [COOH], usually 2/1 to 1/1, preferably 1.5/1 to 1/1, and more preferably 1.3/1 to 1.02/1.

I-2-4 Polyisocyanate

Examples of the polyisocyanate (3) include aliphatic polyisocyanates such as tetramethylene diisocyanate, hexamethylene diisocyanate, and 2,6-diisocyanato methyl caproate; alicyclic polyisocyanates such as isophorone diisocyanate, and cyclohexyl methane diisocyanate; aromatic diisocyanates such as tolylene diisocyanate and diphenylmethane diisocyanate; aromatic-aliphatic diisocyanates such as α,α,α',α'-tetramethylxylene diisocyanate; isocyanurates; the polyisocyanate blocked by phenol derivative, oxime and caprolactam; and a combination thereof.

I-2-5 Ratio of Isocyanate Group to Hydroxyl Group

The ratio of the polyisocyanate (3) is, defined to be an equivalent ratio [NCO]/[OH] of an isocyanate [NCO] to a hydroxyl group [OH] of the polyester having a hydroxyl group, usually 5/1 to 1/1, preferably 4/1 to 1.2/1, and more preferably 2.5/1 to 1.5/1. When the ratio of [NCO]/[OH] is more than 5, the low-temperature fixing property decreases. When the molar ratio of [NCO] is less than 1, the urea content in the modified polyester decreases, and the hot-offset resistance degrades. The content of the polyisocyanate (3) constituent in the polyester prepolymer having an isocyanate group at its end (A) is usually 0.5% by mass to 40% by mass, preferably 1% by mass to 30% by mass, and more preferably 2% by mass to 20% by mass. When the content is less than 0.5% by mass, the hot-offset resistance decreases, and it is disadvantageous in terms of the compatibility between the heat-resistant storage stability and the low-temperature fixing property. When it is more than 40% by mass, the low-temperature fixing property decreases.

I-2-6 the Number of Isocyanate Group in Polyester Prepolymer

The number of isocyanate group included in one molecule of polyester prepolymer having an isocyanate group (A) is usually one or more, preferably 1.5 to 3 on average, and more preferably 1.8 to 2.5 on average. When it is less than one per molecule, the molecular mass of the modified polyester is reduced after cross-linking/elongation, and then the hot-offset resistance decreases.

(I-2-7 Cross-linking Agent and Elongating Agent)

In the present invention, amines may be used as a cross-linking agent and/or elongating agent. Examples of the amines (B) include a diamine compound (B1), a polyamine compound having three or more valences (B2), an amino alcohol (B3), an amino mercaptan (B4), an amino acid (B5) and a component in which an amino group of B1 to B5 is blocked (B6).

The diamine compound (B1) include aromatic diamines such as phenylene diamine, diethyltoluene diamine, 4,4'-diaminodiphenylmethane, and tetrafluoro-p-xylendiamine, tetrafluoro-p-phenylendiamine; alicyclic diamines such as 4,4'-diamino-3,3'-dimethyldicyclohexylmethane, diamine cyclohexane and isophorone diamine; and aliphatic diamines such as ethylene diamine, tetramethylene diamine, hexamethylene diamine, dodecafluoro hexylane diamine and tetracosafluoro dodecylenediamine.

Examples of the polyamine compounds having three or more valences (B2) include diethylenetriamine and triethylenetetramine.

Examples of the amino alcohols (B3) include ethanolamine, diethanolamine and hydroxyethylaniline.

Examples of the amino mercaptans (B4) include an aminomethyl mercaptan and aminopropyl mercaptan.

Examples of the amino acids (B5) include aminopropionic acid and aminocaproic acid.

Examples of the components in which an amino group of B1 to B5 is blocked (B6) include a ketimine compound obtained from the amines B1 to B5 and ketones such as acetone, methyl ethyl ketone and methyl isobutyl ketone; and an oxazolidine compound.

Among these amines (B), B1 and a mixture of B1 with a small amount of B2 are preferable.

I-2-8 Terminator

A terminator may be optionally used for cross-linking and/or elongation to adjust the molecular mass of the modified polyester after terminating the reaction. Examples of the terminators include monoamines such as diethylamine, dibutylamine, butylamine and laurylamine; and a ketimine compound that the amine functionalities thereof are blocked.

(I-2-9 Ratio of Amino Group to Isocyanate Group)

The ratio of the amines (B) is, defined to be an equivalent ratio [NCO]/[$NH_x$] of an isocyanate [NCO] in the polyester prepolymer having an isocyanate group (A) to an amino group [$NH_x$] in the amines (B), usually 1/2 to 2/1, preferably 1.5/1 to 1/1.5, and more preferably 1.2/1 to 1/1.2. When the ratio of [NCO]/[$NH_x$] is more than 2 or less than ½, the molecular mass of the urea-modified polyester decreases, and the hot-offset resistance decreases.

(I-3 Unmodified Polyester)

In the present invention, not only using a modified polyester alone as a binder resin, it is also important that an unmodified polyester (ii) may be included together with the modified polyester (i) as a binder resin. When the modified polyester (i) is used in combination with the unmodified polyester (ii), the low-temperature fixing property and gloss property when used in a full-color device is improved. Examples of the unmodified polyester (ii) include a polycondensation product of a polyol (1) and a polyvalent carboxylic acid (2), and the like, which is the same as the polyester component of the modified polyester (i). Preferable compounds thereof are also the same as the unmodified polyester (ii). As for the unmodified polyester (ii), in addition to an unmodified polyester, it may be a polymer which is modified by a chemical bond other than an urea bond, for example, it may be modified by a urethane bond. It is preferable that at least a part of the modified polyester (i) is compatible with a part of the unmodified polyester (ii), from the aspect of the low-temperature fixing property and hot-offset resistance. Thus, it is preferable that the composition of the modified polyester (i) is similar to that of the unmodified polyester (ii). When the modified polyester (i) is included, the mass ratio of the modified polyester (i) to the unmodified polyester (ii) is usually 5/95 to 75/25, preferably 10/90 to 25/75, and more preferably 12/88 to 25/75, and still more preferably 12/88 to 22/78. When the mass ratio of the modified polyester (i) is less than 5%, it makes hot-offset resistance lower and brings disadvantages in compatibility between heat-resistant storage stability and low-temperature fixing property.

I-3-1 Molecular Mass of Unmodified Polyester

The molecular mass peak of the unmodified polyester (ii) is usually 1,000 to 30,000, preferably 1,500 to 10,000, and more preferably 2,000 to 8,000. When it is less than 1,000, the hot-offset resistance is decreased. When it is more than 10,000, the low-temperature fixing property is decreased. The hydroxyl value of the unmodified polyester (ii) is preferably 5 mg KOH/g or greater, more preferably 10 KOH/g to 120 KOH/g, and still most preferably 20 KOH/g to 80 KOH/g. When it is less than 5 KOH/g, it is disadvantageous in terms of the compatibility between the heat-resistant storage stability and the low-temperature fixing property. The acid value of the unmodified polyester (ii) is usually 0.5 mg KOH/g to 40 mg KOH/g, and preferably 5 mg KOH/g to 35 mg KOH/g. The unmodified polyester tends to be a negative electric property by having an acid value. Each of the acid value and hydroxyl value of the unmodified polyester which exceeds this range may be easily influenced by the environment, and an image may be easily degraded either under high temperature and high humidity, or low temperature and low humidity.

(I-4 Colorant)

The colorant is not particularly limited and may be appropriately selected from the known dyes and pigments. Examples thereof include carbon black, nigrosine dyes, iron black, Naphthol Yellow S, Hansa Yellow (10G, 5G, G), Cadmium Yellow, Yellow Iron Oxide, Yellow Ocher, Chrome Yellow, Titan Yellow, Polyazo Yellow, Oil Yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, Anthracene Yellow BGL, Isoindolinone Yellow, Colcothar, Red Lead Oxide, Lead Red, Cadmium Red, Cadmium Mercury Red, Antimony Red, Permanent Red 4R, Para Red, Fire Red, Parachlororthonitroaniline Red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, eosine lake, Rhodamine Lake B, Rhodamine Lake Y, Alizarine Lake, Thioindigo Red B, Thioindigo Maroon, Oil Red, Quinacridone Red, Pyrazolone Red, Polyazo Red, Chrome Vermilion, Benzidine Orange, Perynone Orange, Oil Orange, Cobalt Blue, Cerulean Blue, Alkali Blue Lake, Peacock Blue Lake, Victoria Blue Lake, metal-free Phthalocyanine Blue, Phthalocyanine Blue, Fast Sky Blue, Indanthrene Blue (RS, BC), Indigo, Ultramarine, Prussian Blue, Anthraquinone Blue, Fast Violet B, Methyl Violet Lake, Cobalt Violet, Manganese Violet, Dioxazine Vviolet, Anthraquinone Violet, Chrome Green, Zinc Green, Chromium Oxide, Viridian, Emerald Green, Pigment Green B, Naphthol Green B, Green Gold, Acid Green Lake, Malachite Green Lake, Phthalocyanine Green, Anthraquinone Green, Titanium Oxide, Zinc White, Lithopone and a combination thereof. The amount of the colorant in the toner is usually 0.1 mass % to 15 mass %, and preferably 3 mass % to 10 mass %.

I-4-1 Masterbatching Colorant

The colorant may be used as a master batch in a composite with a resin as well. Examples of the binder resins melt-kneaded with producing masterbatch or masterbatch, other than the modified and unmodified polyester, include styrenes and polymers of the substitution product thereof such as polystyrene, poly(p-chlorostyrene) and polyvinyltoluene; styrene copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-chloromethyl methacrylate copolymer, styrene-acrylonitrile copolymer, styrene-vinyl methyl ketone copolymer, styrene-butadiene copolymer, styrene-isoprene copolymer, and styrene-acrylonitrile-indene copolymer, styrene-maleic acid copolymer, styrene-maleate copolymer; polymethylmethacrylate, polybutylmethacrylate, polyvinyl chloride, polyvinyl acetate, polyethylene, polypropylene, polyester, an epoxy resin, an epoxy polyol resin, polyurethane, polyamide, polyvinyl butyral, a polyacrylic acid resin, rosin, modified rosin, terpene, a aliphatic or alicyclic hydrocarbon resin, an aromatic petroleum resin, chlorinated paraffin and paraffin wax. These may be used alone or in combination.

I-4-2 Method for Producing Master Batch

The master batch can be produced by mixing and kneading the resin and colorant for a master batch under high shear force. An organic solvent may be added to increase interaction between the colorant and the resin. A flushing method is preferably used to produce the master batch, because a wet cake of the colorant can be used directly without drying. The flushing method may be used in which an aqueous paste containing water and a colorant is mixed and kneaded together with the resin and the organic solvent so that the colorant approaches to the resin and then the water and the organic solvent are removed thereafter. For the mixing and kneading, a high shear dispersing machine such as a three roller mill, or the like may be preferably used. In addition, the master batch may be prepared and used as a dispersion and solution (wet master) for the organic solvent for the oil phase to enhance the dispersibility and solubility to the solvent when forming the oil phase.

(I-5 Wax)

The toner contains a wax as a releasing agent together with the binder resin and the colorant. The known wax may be used, for example, the wax described in "Properties and application of wax Revised 2nd edition", supervised by Kenzo Fusegawa, Saiwai shobo. Examples of the wax include polyolefins such as polyethylene wax and polypropylene wax; paraffins such as paraffin wax, SASOL wax; synthetic esters such as trimethylolpropane tribehenate, pentaerythritol tetrabehenate, pentaerythritol diacetate dibehenate, glycerin tribehenate and 1,18-octadecanediol distearate, tristearyl trimellitate, distearyl maleate, octadecyl stearate; natural plant waxes such as carnauba wax, rice wax, candelilla wax; natural mineral waxes such as montan wax, ozokerite, ceresin; synthetic waxes of fatty acid amide such as stearic acid amide.

Among these, the polyolefins, the paraffins, the synthetic esters, the carnauba wax and the rice wax are preferable, and may be used alone or in combination.

The amount of the wax in the toner is 2 parts by mass to 30 parts by mass, and preferably 4 parts by mass to 15 parts by mass based on 100 parts by mass of the resin. When the amount of the wax is less than 4 parts by mass, the wax is exuded on the surface of the fixing member so as not to adhere to the fixing member when fixing, however, the releasing property is not effective enough depending on the kinds of wax due to the small amount of the wax, thus the hot-offset margin may be lost. On the other hand, when the amount of the wax is more than 15 parts by mass, the wax is easily suffered from the effect of heat energy and mechanical energy, as the wax melts at low temperature. When the low-melting point wax is used, for example, in a two-component toner, the wax may be detach from the toner surface during stirring with the carrier in a developing portion, and attached to a toner control member and a photoconductor, thereby generating an image noise. When it is used in a one-component toner, the wax may be attached to a blade in a developing control portion, thereby generating an image noise.

The endothermic peak of the wax upon temperature rising measured by a differential scanning calorimeter (DSC) is preferably 65° C. to 115° C. and the toner can be fixed at low temperature. When the melting point is less than 65° C., the flowability may be decreased. When the melting point is more than 115° C., the fixing property tends to be decreased.

A wax dispersing agent may be used to control the wax so that the wax can exist near the toner surface. For the wax dispersing agent, a monomer for a toner binder, which has a low affinity for water when the toner is emulsified, of which a product of polymerization reaction is incompatible with or less compatible with the wax is preferably used. 50% to 200% of the wax dispersing agent relative to the wax is added, dispersed and polymerized so that the wax can exist in an inner part of the toner particles through to near the toner surface. Common monomers for the toner binder can be used for that of less compatible with the wax. Examples thereof include styrene monomers such as styrene, α-methyl styrene, p-methyl styrene, m-methyl styrene, p-methoxystyrene, p-hydroxystyrene, p-acetoxystyrene, vinyltoluene, ethylstyrene, phenylstyrene and benzylstyrene; unsaturated carboxylic acid alkyl (1 to 18 carbon atoms) esters such as methyl (meth)acrylate, ethyl(meth)acrylate, buthyl(meth)acrylate, and 2-ethylhexyl(meth)acrylate; vinyl ester monomers such as vinyl acetate; vinyl ether monomers such as vinyl methyl ether; halogen containing vinyl monomers such as vinyl chloride; diene monomers such as butadiene and isobutylene; unsaturated nitrile monomers such as(meth)acrylonitrile and cyanostyrene, and combinations of these monomers. The wax dispersing agent is not particularly limited, and may be appropriately selected depending on the intended purpose. The material which has a high-affinity site for the wax, and a high-affinity site for the binder resin may be basically used, for example, styrene-(meth)acrylic ester copolymer grafted to polyethylene wax is preferably used. The content of the wax dispersing agent in the toner can be adjusted depending on the intended purpose, for example, 1 part by mass to 200 parts by mass, particularly preferably 10 parts by mass to 150 parts by mass based on the 100 parts by mass of the total content of the wax.

I-6 Organic Solvent (Oil Phase)

The toner of the invention is prepared as follows: the toner composition containing at least the polyester as a binder resin, the colorant, and the wax is dissolved or dispersed into an organic solvent, and the dissolved or dispersed substance is emulsified or dispersed in an aqueous medium in the presence of a radical generator with an inorganic dispersing agent or resin fine particles, and then the solvent is removed. The polyester as the binder resin does not contain vinyl polymer group.

The organic solvent which dissolves or disperses the toner composition containing the polyester as a binder resin, the colorant, and the wax has preferably a Hansen solubility parameters of 19.5 or less, for example, the organic solvent described in "POLYMER HANDBOOK" 4th Edition, Volume 2, Section VII, WILEY-INTERSCIENCE. In addition, it is more preferably volatile and has a boiling point of lower than 150° C. in terms of easy removal of solvent afterward. Examples of the organic solvents include hexane, cyclohexane, toluene, xylene, benzene, carbon tetrachloride, 1,1-dichloroethane, 1,1,1-trichloroethane, trichloroethylene, chloroform, methyl acetate, ethyl acetate, butyl acetate, methyl ethyl ketone, and tetrahydrofuran. These are used alone or in combination.

II. Material for Aqueous Medium

II-1 Aqueous Medium

The aqueous medium may be water alone, alternatively the aqueous medium may be used with a solvent which can be mixed with water. Examples of the solvents mixable with water include alcohol such as methanol, isopropanol, and ethylene glycol; dimethylformamide; tetrahydrofuran; cellosolves such as methyl cellosolve; and a lower ketone such as acetone and methyl ethyl ketone. The organic solvent having a Hansen solubility parameters of 19.5 or less, which is described in the oil phase, may be mixed. When the amount to be added thereof is near water saturation, it preferably facilitates the emulsification of the oil phase and enhances the dispersion stability. The amount of the aqueous medium is preferably 50 parts by mass to 2,000 parts by mass, more preferably 100 parts by mass to 1,000 parts by mass based on 100 parts by mass of the toner composition. When the amount is less than 50 parts by mass, the toner composition is dispersed insufficiently within the aqueous medium, thus the toner particles having a predetermined particle diameter cannot be obtained. When the amount is more than 20,000 parts by mass, it is not economical. The radical generators added to an aqueous medium is not limited as long as they are water dispersible or water soluble, and may be used alone or in combination. In addition, a combination of an oxidizing agent and a reducing agent may be used for taking advantage of an oxidation-reduction reaction. The amount to be added thereof is adjusted depending on the kinds of the radical generator and the granulation temperature based on the solid content of the toner. It is 0.1 mass % to 20 mass %, and preferably 0.5 mass % to 10 mass %.

II-2 Radical Generator

The radical generator, known as a polymerization initiator, can be used. For example, it is the radical generator described in "POLYMER HANDBOOK" 4th Edition, Volume 1, Section II, WILEY-INTERSCIENCE. The radical generator may be added to the oil phase and/or water phase. When added to the oil phase, the oil-soluble polymerization initiator is preferably used. When added to the aqueous phase, the water-soluble polymerization initiator is preferably used.

Examples of the oil-soluble polymerization initiators include azo-based or diazo-based polymerization initiators such as 2,2'-azobis (2,4-dimethylvaleronitrile), 2,2'-azobisisobutylonitrile, 1,1'-azobis (cyclohexane-1-carbonitrile), 2,2'-azobis-4-methoxy-2,4-dimethylvaleronitrile, azobisisobutyronitrile; peroxide-based polymerization initiators such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butyl peroxycyclohexyl)propane, tris-(t-butylperoxy) triazine; and a polymerization initiator having peroxide at its side chain.

The water-soluble polymerization initiators include persulfates such as potassium persulfate, ammonium persulfate, 2,2'-azobis(2-methylpropionic amidine dihydrochloride), 2,2-azobis[N-(2-carboxyethyl)-2-methylpropionic amidine], 4,4'-azobis(4-cyanovaleric acid) azobisamino dipropane acetate, azobiscyano valeric acid and salt thereof, and hydrogen peroxide.

II-3 Inorganic Dispersing Agent

The dissolved and dispersed substances of the toner composition are dispersed in the aqueous medium in the presence of the inorganic dispersing agent or resin fine particles.

Examples of the inorganic dispersing agents include tricalcium phosphate, calcium carbonate, titanium oxide, colloidal silica, and hydroxyapatite. It is preferable to use the dispersing agent, because the toner may have the sharp particle diameter distribution and be dispersed stably.

II-4 Resin Fine Particles

It is preferable to add resin fine particles to the toner of the invention. Any resin may be used as a resin which forms resin fine particles, as long as the resin can form an aqueous dispersion. It may be either thermoplastic or thermoset, and examples thereof include a vinyl resin, a polyurethane resin, an epoxy resin, a polyester resin, a polyamide resin, a polyimide resin, a silicon resin, a phenol resin, a melamine resin, a urea resin, an aniline resin, an ionomer resin, a polycarbonate resin. These resins may be used in combination. Among these, the vinyl resin, the polyurethane resin, the epoxy resin, the polyester resin and the combination thereof are preferable from the viewpoint that an aqueous dispersion of microfine spherical resin particles can be easily obtained.

II-4-1 Vinyl Resin

A vinyl resin is a polymer which is formed by polymerizing or copolymerizing vinyl monomers. Examples of vinyl monomers are described in the following (1) to (10).

(1) Vinyl Hydrocarbons:

Aliphatic vinyl hydrocarbons: alkenes such as ethylene, propylene, butene, isobutylene, pentene, heptene, diisobutylene, octene, dodecene, octadecene, and other α-olefins; alkadienes such as butadiene, isoprene, 1,4-pentadiene, 1,6-hexadiene, 1,7-octadiene and the like. Alicyclic vinyl hydrocarbons: mono- or di-cyclo-alkenes and alkadienes such as cyclohexene, (di)cyclopentadiene, vinylcyclohexene, ethylidenebicycloheptene,and the like; terpenes such as pinene, limonene, indene, and the like. Aromatic vinyl hydrocarbons: styrene and hydrocarbyl (alkyl, cycloalkyl, aralkyl and/or alkenyl)-substituted styrene, for example, α-methylstyrene, vinyltoluene, 2,4-dimethylstyrene, ethylstyrene, isopropylstyrene, butylstyrene, phenylstyrene, cyclohexylstyrene, benzylstyrene, crotylbenzene, divinylbenzene, divinyltoluene, divinylxylene, trivinylbenzene, and the like; and vinylnaphthalene.

(2) Carboxyl group-containing vinyl monomers and salts thereof: unsaturated monocarboxylic acids and unsaturated dicarboxylic acids having 3 to 30 carbon atoms, and their anhydrides and monoalkyl (1 to 24 carbon atoms) esters, such as (meth)acrylic acids, maleic acid (anhydride), maleic acid monoalkyl esters, fumaric acid, fumaric acid monoalkyl esters, crotonic acid, itaconic acid, itaconic acid monoalkyl esters, itaconic acid glycol monoesters, citraconic acid, citraconic acid monoalkyl esters, cinnamic acid, and the like.

(3) Sulfonic acid group-containing vinyl monomers and vinyl sulfuric acid monoester compounds and salts thereof: alkenesulfonic acids having 2 to 14 carbon atoms, such as vinylsulfonic acid, (meth)allylsulfonic acid, methylvinylsulfonic acid, and styrenesulfonic acid; and alkyl (2 to 24 carbon atoms) derivatives thereof, such as α-methylstyrenesulfonic acid and the like; sulfo(hydroxy)alkyl-(meth)acrylate or -(meth)acrylamides, for example, sulfopropyl(meth)acrylate, 2-hydroxy-3-(meth)acryloyloxypropylsulfonic acid, 2-(meth)acryloylamino-2,2-dimethylethanesulfonic acid, 2-(meth)acryloyloxyethanesulfonic acid, 3-(meth)acryloyloxy-2-hydroxypropanesulfonic acid, 2-(meth)acrylamido-2-methylpropanesulfonic acid, 3-(meth)acrylamido-2-hydroxypropanesulfonic acid, alkyl (3 to 18 carbon atoms) allylsulfosuccinic acid, poly(n=2 to 30)oxyalkylene (ethylene, propylene, butylene; homo, random or block) mono (meth)acrylate sulfate [poly(n=5 to 15)oxypropylene monomethacrylate sulfate etc.], polyoxyethylene polycyclic phenyl ether sulfate.

(4) Phosphoric acid group-containing vinyl monomers and salts thereof: phosphoric acid (meth)acryloyloxyalkyl monoesters, such as 2-hydroxyethyl(meth)acryloylphosphate, phenyl-2-acryloyloxyethyl phosphate and (meth)acryloyloxyalkyl (1 to 24 carbon atoms) phosphonates such as 2-acryloyloxyethyl phosphonate, and salts thereof. The salts of the above compounds (2) to (4) include the corresponding alkali metal salts (such as sodium salts, potassium salts), alkaline earth metal salts (such as calcium salts, magnesium salts), ammonium salts, amine salts, and quaternary ammonium salts.

(5) Hydroxyl group-containing vinyl monomers: hydroxystyrene, N-methylol(meth)acrylamide, hydroxyethyl(meth) acrylate, hydroxypropyl(meth) acrylate, polyethylene glycol mono(meth)acrylate, (meth)allyl alcohol, crotyl alcohol, isocrotyl alcohol, 1-buten-3-ol, 2-buten-1-ol, 2-butene-1,4-diol, propargyl alcohol, 2-hydroxyethyl propenyl ether, sucrose allyl ether, and the like.

(6) Nigrogen-containing vinyl monomers:

Amino group-containing vinyl monomers: aminoethyl (meth)acrylate, dimethylaminoethyl(meth)acrylate, diethylaminoethyl(meth)acrylate, t-butylaminoethyl methacrylates, N-aminoethyl(meth)acrylamide, (meth)allylamine, morpholinoethyl (meth)acrylate, 4-vinylpyridine, 2-vinylpyridine, crotylamine, N,N-dimethylaminostyrene, methyl-α-acetoaminoacrylate, vinylimidazole, N-vinylpyrrole, N-vinylthiopyrrolidone, N-arylphenylenediamine, aminocarbazole, aminothiazole, aminoindole, aminopyrrole, aminoimidazole, and aminomercaptothiazole, and salts thereof. Amide group-containing vinyl monomers: (meth) acrylamide, N-methyl(meth)acrylamide, N-butylacrylamide, diacetoneacrylamide, N-methylol(meth)acrylamide, N,N'-methylene-bis(meth)acrylamide, cinnamic acid amide, N,N-dimethylacrylamide, N,N-dibenzylacrylamide, methacrylformamide, N-methyl-N-vinylacetamide, N-vinylpyrrolidone, and the like, Nitrile group-containing vinyl monomers: (meth)acrylonitrile, cyanostyrene, cyanoacrylates, and the like. Quaternary ammonium cation group-containing vinyl monomers: quaternization products of tertiary amine group-containing vinyl monomers such as dimethylaminoethyl(meth)acrylate, diethylaminoethyl (meth)acrylate, dimethylaminoethyl(meth)acrylamide, diethylaminoethyl(meth)acrylamide, diallylamine, and the like (as quaternized with a quaternizing agent such as methyl chloride, dimethylsulfuric acid, benzyl chloride, dimethyl carbonate and the like). Nitro group-containing vinyl monomers: nitrostyrene and the like.

(7) Epoxy group-containing vinyl monomers: glycidyl (meth)acrylate, tetrahydrofurfuryl(meth)acrylate, p-vinylphenylphenyl oxide, and the like.

(8) Vinyl esters, vinyl(thio)ethers, vinyl ketones and vinyl sulfones: vinyl esters, such as vinyl acetate, vinyl butyrate, vinyl propionate, vinyl butyrate, diallyl phthalate, diallyl adipate, isopropenyl acetate, vinyl methacrylate, methyl-4-vinylbenzoate, cyclohexyl methacrylate, benzyl methacrylate, phenyl(meth)acrylate, vinyl methoxyacetate, vinyl benzoate, ethyl-α-ethoxyacrylate, alkyl(meth)acrylates having an alkyl group with 1 to 50 carbon atoms [methyl(meth)acrylate, ethyl (meth)acrylate, propyl(meth)acrylate, butyl(meth)acrylate, 2-ethylhexyl(meth)acrylate, dodecyl(meth)acrylate, hexadecyl(meth)acrylate, heptadecyl(meth)acrylate, eicosyl(meth) acrylate, etc.], dialkyl fumarates (each of the two alkyl groups is a straight-chain, branched, or cyclic group having 2 to 8 carbon atoms), dialkyl maleates (each of the two alkyl groups is a straight-chain, branched, or cyclic group having 2 to 8 carbon atoms), poly(meth)allyloxyalkanes [diallyloxyethane, triallyloxyethane, tetraallyloxyethane, tetraallyloxypropane, tetraallyloxybutane, tetramethallyloxyethane, etc.], and the like, vinyl monomers having a polyalkylene glycol chain [polyethylene glycol (molecular mass 300) mono(meth)acrylate, polypropylene glycol (molecular mass 500) monoacrylate, methyl alcohol-ethylene oxide (10 mol) adduct (meth)acrylates, lauryl alcohol-ethylene oxide (30 mol) adduct (meth)acrylates, etc.], poly(meth)acrylates [poly (meth)acrylates of polyhydric alcohols: ethylene glycol di(meth)acrylate, propylene glycol di(meth)acrylate, neopentyl glycol di(meth)acrylate, trimethylolpropane tri(meth) acrylate, polyethylene glycol di(meth)acrylate, etc.], and the like; vinyl(thio)ethers, such as vinyl methyl ether, vinyl ethyl ether, vinyl propyl ether, vinyl butyl ether, vinyl-2-ethylhexyl ether, vinyl phenyl ether, vinyl-2-methoxyethyl ether, methoxybutadiene, vinyl-2-butoxyethyl ether, 3,4-dihydro-1,2-pyran, 2-butoxy-2'-vinyloxy diethyl ether, vinyl-2-ethylmercaptoethyl ether, acetoxystyrene, phenoxystyrene; vinyl ketones, such as vinyl methyl ketone, vinyl ethyl ketone, vinyl phenyl ketone; vinyl sulfones, such as divinyl sulfide, p-vinyldiphenyl sulfide, vinylethyl sulfide, vinyl ethyl sulfone, divinyl sulfone, divinyl sulfoxide, and the like.

(9) Other vinyl monomers: isocyanatoethyl(meth)acrylate, m-isopropenyl-α,α-dimethylbenzyl isocyanate, and the like.

(10) Fluorine atom-containing vinyl monomers: 4-fluorostyrene, 2,3,5,6-tetrafluorostyrene, pentafluorophenyl (meth)acrylate, pentafluorobenzyl(meth)acrylate, perfluorocyclohexyl(meth)acrylate, perfluorocyclohexylmethyl (meth)acrylate, 2,2,2-trifluoroethyl(meth)acrylate, 2,2,3,3-tetrafluoropropyl(meth)acrylate, 1H,1H,4H-hexafluorobutyl (meth)acrylate, 1H,1H,5H-octafluoropentyl(meth)acrylate, 1H,1H,7H-dodecafluoroheptyl(meth)acrylate, perfluorooctyl(meth)acrylate, 2-perfluorooctyl ethyl(meth)acrylate, heptadecafluorodecyl(meth)acrylate, trihydroperfluoroundecyl (meth)acrylate, perfluoronorbornylmethyl(meth)acrylate, 1H-perfluoroisobornyl(meth)acrylate, 2-(N-butyl perfluorooctansulfonamide)ethyl(meth)acrylate, 2-(N-ethyl perfluorooctansulfonamid)ethyl(meth)acrylate, and corresponding compounds derived from α-fluoro acrylic acid such as bis-hexafluoroisopropyl itaconate, bis-hexafluoroisopropyl maleate, bis-perfluorooctyl itaconate, bis-perfluorooctyl maleate, bis-trifluoroethyl itaconate, bis-trifluoroethyl maleate, vinyl heptafluorobutylate, vinyl perfluoroheptanoate, vinyl perfluoronanoate, and vinyl perfluorooctanoate, and the like.

II-4-2 Vinyl Copolymer

The copolymers of vinyl monomers are, for example, polymers formed by copolymerizing two or more of any monomer described in the above (1) to (10) at any rate. Examples thereof include a styrene-(meth)acrylic ester copolymer, a styrene-butadiene copolymer, a (meth)acrylic acid-acrylic ester copolymer, a styrene-acrylonitrile copolymer, a styrene-maleic anhydride copolymer, a styrene-(meth)acrylic acid copolymer, a divinylbenzene copolymer, and a styrene-styrenesulfonate-(meth)acrylic ester copolymer. When fluorine is introduced to resin fine particles, any one or more of the monomer in the above (10) are copolymerized at any rate.

II-4-3 Ratio of Monomer in Vinyl Resin

It is necessary that the above resins are not completely dissolve in water at least under the condition of forming aqueous dispersion, so that the resins may form the resin fine particles in the aqueous dispersion. Therefore, when the vinyl resin is a copolymer, the relative amount of the hydrophobic monomer and hydrophilic monomer constituting the vinyl resin depends on the kinds of the selected monomers. The ratio of hydrophobic monomer is generally preferably the 10% or more, and more preferably 30%. If the ratio of the hydrophobic monomer is less than 10%, the vinyl resin may become water-soluble and the uniformity of the toner particles diameter may be adversely affected. The hydrophilic monomer described herein is a monomer which is soluble in water in any ratio, while the hydrophobic monomer is a monomer other than the hydrophilic monomer, that is a monomer which is essentially immiscible with water.

II-4-4 Method of Dispersing Resin Fine Particles into Aqueous Dispersion

The methods for processing a resin into an aqueous dispersion of resin fine particles are not limited, and examples thereof include the following (a) to (h):

(a) In the case of a vinyl resin, a monomer is used as a starting material, the aqueous dispersion of resin fine particles is directly produced by the polymerization, such as suspension polymerization, emulsion polymerization, seed polymerization and dispersion polymerization.

(b) In the case of a polyaddition or condensation resin, such as a polyester resin, a polyurethane resin, and an epoxy resin, the aqueous dispersion of resin fine particles is produced by dispersing a precursor (a monomer, an oligomer and the like) or a solvent solution thereof in an aqueous medium in the presence of a suitable dispersing agent, and then curing by heating or adding a curing agent.

(c) In the case of a polyaddition or condensation resin such as a polyester resin, a polyurethane resin, and an epoxy resin, an appropriate emulsifier is dissolved in a precursor (such as a monomer, an oligomer and the like) or a solvent solution thereof which is preferably a liquid and may be liquefied by heating, and then adding water for phase-reversal emulsification.

(d) A resin prepared by a polymerization reaction, which may be any polymerization reaction mode, such as addition polymerization, ring-opening polymerization, polyaddition polymerization, addition-condensation polymerization, and condensation polymerization, in advance, is crushed with a mechanical rotary, jet type or other micropulverizer, and the resulting powder is classified to obtain resin fine particles, and then the obtained resin fine particles are dispersed in water in the presence of an appropriate dispersing agent.

(e) A resin solution in which a resin prepared by a polymerization reaction, which may be any polymerization reaction mode, such as addition polymerization, ring-opening polymerization, polyaddition polymerization, addition-condensation polymerization, and condensation polymerization, in advance, is dissolved, and the resulting resin solution is sprayed in a mist form to obtain resin fine particles, and the obtained resin fine particles are dispersed in water in the presence of an appropriate dispersing agent.

(f) A solvent is added to a resin solution in which a resin prepared by a polymerization reaction, which may be any polymerization reaction mode, such as addition polymerization, ring-opening polymerization, polyaddition polymerization, addition-condensation polymerization, and condensation polymerization, in advance, is dissolved, or a resin solution in which a resin is dissolved by heating in advance is cooled to precipitate resin fine particles, and then the solvent is removed to obtain resin fine particles, and the obtained resin fine particles are dispersed in water in the presence of a suitable dispersing agent.

(g) A resin solution in which a resin prepared by a polymerization reaction, which may be any polymerization reaction mode, such as addition polymerization, ring-opening polymerization, polyaddition polymerization, addition-condensation polymerization, and condensation polymerization, in advance, is dissolved, and the resulting resin solution is dispersed in an aqueous medium in the presence of a suitable dispersing agent, and then the aqueous dispersion is heated or decompressed to remove the solvent.

(h) A suitable emulsifier is dissolved in a resin solution in which a resin prepared by a polymerization reaction, which may be any polymerization reaction mode, such as addition polymerization, ring-opening polymerization, polyaddition polymerization, addition-condensation polymerization, and condensation polymerization, in advance, is dissolved, and then water is added for phase-reversal emulsification.

II-4-5 Particle Diameter of Resin Fine Particles

The particle diameter of resin fine particles is usually smaller than the particle diameter of the toner, and from the viewpoint of the uniformity of particle diameter, the value of the particle diameter ratio, [volume average particle diameter of the resin fine particles]/[volume average particle diameter of the toner], is preferably 0.001 to 0.3. When the particle diameter ratio is larger than 0.3, the resin fine particles may not be efficiently adsorbed on the surface of toner, and the particle diameter distribution of the toner may tend to be wider. The volume average particle diameter of the resin fine particles can be adjusted within the above range of particle diameter ratio so that it may be suited for forming a toner having the desired particle diameter. For example, when it is desired to obtain a toner having a volume average particle diameter of 5 μm, the volume average particle diameter of the resin fine particles is preferably be 0.0025 μm to 1.5 μm, particularly preferably 0.005 μm to 1.0 μm. When it is desired to obtain a toner having a volume average particle diameter of 10 μm, the volume average diameter of the resin fine particles is preferably 0.005 μm to 3.0 μm, particularly preferably 0.05 μm to 2 μm. The volume average particle diameter can be measured by the laser Doppler system particle size analyzer (UPA 150 by Nikkiso Co., Ltd.), the laser particle size distribution analyzer LA-920 (by HORIBA, Ltd.) or Multisizer II (by Coulter).

(II-5 Surfactant)

In order to emulsify and disperse the oil phase containing the toner composition into the aqueous medium, surfactants may be added optionally.

Examples of the surfactants include anionic surfactants such as alkylbenzene sulfonate, α-olefin-sulfonate and phosphate; cationic surfactants of amine salt type such as alkylamine salt, amino alcohol fatty acid derivative, polyamine fatty acid derivative and imidazoline; cationic surfactants of quaternary ammonium salt type such as alkyltrimethyl ammonium salt, dialkyldimethyl ammonium salt, alkyldimethylbenzyl ammonium salt, pyridinium salt, alkylisoquinolinium salt and benzethonium chloride; nonionic surfactants such as fatty amide derivative and polyol derivative; and amphoteric surfactants such as alanine, dodecyldi(aminoethyl)glycine, di(octylaminoethyl) glycine and N-alkyl-N,N-dimethyl ammonium betaine. In addition, the use of a surfactant having a fluoroalkyl group may largely enhance the effect even in a small amount. Examples of the anionic surfactants having a fluoroalkyl group preferably used include fluoroalkylcarboxylate having 2 to 10 carbon atoms and its metal salt, perfluoro octanesulfonyl disodium glutamate, 3-[omega-fluoroalkyloxy ($C_6$ to $C_{11}$)]-1-alkyl ($C_3$ to $C_4$) sodium sulfonate, 3-[omega-fluoroalkanoyl ($C_6$ to $C_8$)-N-ethylamino]-1-propane sodium sulfonate, fluoroalkyl ($C_6$ to $C_{20}$) carboxylic acid and its metal salt, perfluoroalkyl carboxylic acid ($C_7$ to $C_{13}$) and its metal salt, perfluoroalkyl ($C_4$ to $C_{12}$) sulfonic acid and its metal salt, perfluorooctane sulfonic acid diethanolamide, N-propyl-N-(2-hydroxyethyl)perfluorooctane sulfonamide, perfluoroalkyl ($C_6$ to $C_{10}$) sulfonamidepropyltrimethyl ammonium salt, perfluoroalkyl ($C_6$ to $C_{10}$)-N-ethylsulfonylglycin salt and monoperfluoroalkyl ($C_6$ to $C_{16}$) ethylphosphate. Examples of the cationic surfactants include an aliphatic primary and secondary acids or secondary amine acid having fluoroalkyl group; an aliphatic quaternary ammonium salt such as perfluoroalkyl ($C_6$ to $C_{10}$) sulfonamide propyltrimethyl ammonium salt; benzalkonium salt; benzethonium chloride; a pyridinium salt; and an imidazolinium salt.

(II-6 Protective Colloid)

The dispersed droplets may be stabilized with a polymeric protective colloid. Examples thereof include acids such as acrylic acid, methacrylic acid, α-cyanoacrylic acid, α-cyanomethacrylic acid, itaconic acid, crotonic acid, fumaric acid, maleic acid, and maleic anhydride; (meth)acrylic monomer having a hydroxyl group such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro- 2-hydroxypropyl acrylate, 3-chloro -2-hydroxypropyl methacrylate, diethylene glycol monoacrylic ester, diethylene glycol monomethacrylic ester, glycerine monoacrylic ester, glycerine monomethacrylic ester, N-methylolacrylamide and N-methylolmethacrylamide; vinyl alcohols or ethers of vinyl alcohol such as vinyl methyl ether, vinyl ethyl ether and vinyl propyl ether; esters of vinyl alcohol and a compound having a carboxyl group such as vinyl acetate, vinyl propionate and vinyl butyrate; acrylamide, methacrylamide, diacetone acrylamide and methylol compounds thereof; acid chlorides such as acrylic acid chloride and methacrylic acid chloride; homopolymers or copolymers having a nitrogen atom or a heterocyclic ring thereof such as vinylpyridine, vinylpyrrolidone, vinylimidazole and ethyleneimine; polyoxyethylenes such as polyoxyethylene, polyoxypropylene, polyoxyethylene alkyl amine, polyoxypropylene alkyl amine, polyoxyethylene alkyl amide, polyoxypropylene alkyl amide, polyoxyethylene nonyl phenyl ether, polyoxyethylene lauryl phenyl ether, polyoxyethylene stearyl phenyl ester and polyoxyethylene nonyl phenyl ester; and celluloses such as methyl cellulose, hydroxyethyl cellulose and hydroxypropyl cellulose. When an acid- or alkali-soluble substance such as a calcium phosphate salt is used as a dispersion stabilizer, the calcium phosphate salt is removed from fine particles using the method in which a calcium phosphate salt is dissolved by an acid such as hydrochloric acid, followed by washing. The calcium phosphate salt can be removed by the decomposition by other enzymes. When a dispersing agent is used, the dispersing agent may be left on the surface of the toner particles. However, it is preferable that the dispersing agent is washed away from the surface of the toner particles after elongation and/or cross-linking reaction in terms of charging the toner.

III. Dispersing and Emulsifying Method

The dispersing and emulsifying method is not limited, and the known apparatus such as low-speed shearing, high-speed shearing, friction, high-pressure jet and ultrasonic apparatuses may be applied. It is preferably a high-speed shearing apparatus in order to have a particle diameter of the dispersions of 2 μm to 20 μm. For a high-speed shearing distribution apparatus, the number of revolutions is not particularly limited, but it is usually 1,000 rpm to 30,000 rpm, and more preferably 5,000 rpm to 20,000 rpm. The dispersion time is not particularly limited, but in a batch processing system, it is usually 0.1 minutes to 5 minutes. The dispersion temperature is usually 0° C. to 150° C. under pressurization, and preferably 20° C. to 90° C. High temperature is preferable from the viewpoint that the dispersions containing the toner composition which contains a polyester has low viscosity, and disperses easily.

To facilitate radical generation from the radical generator, it is preferable to heat appropriately, for example, based on half-life temperature for decomposition, in the range from 20° C. to 90° C. During the process of dispersion and desolvation, the heat treatment may be performed appropriately.

IV. Elongation

In the invention, when an urea modified polyester is formed from a polyester prepolymer containing an isocyanate group, amines and a sulfonating agent are mixed in the oil phase and then amines may be reacted with the prepolymer before a toner composition is dispersed in the aqueous medium, or after the toner composition is dispersed in the aqueous medium so as to induce a reaction from the particle interface. In the latter, the urea modified polyester is preferentially formed on the surface of the toner particles to be produced, and the concentration gradient can be generated inside of the particles. The reaction time is selected depending on reactivity between an isocyanate group structure contained in the polyester prepolymer and the amines, and usually 1 minute to 40 hours, preferably 1 hour to 24 hours. The reaction temperature is usually 0° C. to 150° C., preferably 20° C. to 98° C. If necessary, the known catalysts can be used. Specifically, examples of the catalysts include a dibutyltin laurate, and a diocryltin laurate.

V. Desolvation

To remove the organic solvent from the obtained emulsified dispersion, a method of gradually raising a temperature of the whole dispersion to completely remove the organic solvent from the droplet by vaporizing can be used. Alternatively, it is possible to spray the emulsified dispersion in a dry ambient atmosphere so as to completely remove a water-insoluble organic solvent from the droplet thereby forming toner particles, while a water dispersing agent is removed by vaporizing. Examples of the typical dry ambient atmosphere in which the emulsified dispersion is sprayed include an atmospheric air, a nitrogen gas, a carbon dioxide gas, a gaseous body in which a combustion gas is heated, and various aerial currents heated to have a temperature not less than a highest boiling point of a solvent which is particularly used. A spray dryer, a belt dryer and a rotary kiln can sufficiently remove the organic solvent in a short time to obtain a desired quality.

VI. Wet Classification

When a particle diameter distribution is wide at the time of emulsifying and dispersing, and washing and drying are performed while maintaining the wide particle diameter distribution, the obtained powder (toner powder) can be classified to have a desired particle diameter distribution. A cyclone, a decanter, a centrifugal separation, etc. enables the classification for removing fine particles in the liquid. The classified can also be carried out on the powder after drying, but it is preferable that the classification is carried out in the liquid in terms of efficiency. Unnecessary fine and coarse particles can be recycled to a kneading process to form particles. The fine and coarse particles may be wet when recycled. A dispersing agent is preferably removed from the dispersion as soon as possible, and more preferably removed at the same time when the above-classification is performed.

VII. External Additive Treatment

Heterogeneous particles such as releasing agent fine particles, charge control fine particles, fluidizing agent fine particles and colorant fine particles can be mixed with a toner powder obtained after drying. Release of the heterogeneous particles from composite particles can be prevented by giving a mechanical stress to the mixed powder so as to fix and fuse them on a surface of the composite particles. Specific methods include a method of applying impact strength on a mixture by rotating a blade at a high-speed, a method of charging a mixture in a high-speed stream to accelerate such that particles thereof collide each other or composite particles thereof collide with a collision board, and the like. Examples of the apparatus include an ONG MILL by Hosokawa Micron Corp., a modified I-type mill (by Nippon Pneumatic Mfg. Co., Ltd.) with a lower pulverizing air pressure, a hybridization system by Nara Machinery Co., Ltd., a Kryptron System by Kawasaki Heavy Industries, Ltd., and an automatic mortar.

VIII. External Additive

VIII-1 Inorganic Particles

Inorganic particles are preferably used as an external additive for assisting in flowability of coloring particles, developing property, and charge property. The primary particle diameter of the inorganic fine particle is preferably 5 nm to 2 μm, and more preferably 5 nm to 500 nm. The specific surface are of the inorganic fine particle by BET method is preferably 20 $m^2/g$ to 500 $m^2/g$. The added amount of the inorganic fine particle is preferably 0.01% by mass to 5.0% by mass, more preferably 0.01% by mass to 2.0% by mass based on the toner. Examples of the inorganic fine particles include silica, alumina, titanium oxide, barium titanate, magnesium titanate, calcium titanate, strontium titanate, zinc oxide, tin oxide, silica sand, clay, mica, wollastonite, diatom earth, chrome oxide, cerium oxide, colcothar, antimony trioxide, magnesium oxide, zirconium oxide, barium sulfate, barium carbonate, calcium carbonate, silicon carbide and silicon nitride.

VIII-2 Polymer Fine Particles

Other polymer fine particles include polystyrene obtained by a soap-free emulsion polymerization, a suspension polymerization method, and a dispersion polymerization method; methacrylic acid ester copolymer, acrylic ester copolymer; condensation polymers such as silicone, benzoguanamine, nylon; and polymer particles of thermosetting resins.

VIII-3 Surface-Treatment of External Additives

These external additives are surface-treated to enhance its hydrophobic property, and it can prevent the degradation of the flowability and charge property even under high humidity. Preferable examples of the surface treatment agents include a silane coupling agent, a silylation agent, a silane coupling agent having an alkyl fluoride group, an organic titanate coupling agent, an aluminate coupling agent, a silicone oil and a modified silicone oil.

IX. Cleaning Improver

The cleaning improver is added to the toner to remove a developer remaining on a photoconductor and on a primary transferring member after a transferring step. Examples thereof include fatty acid metal salts such as zinc stearate, calcium stearate, and stearic acid; and polymer particles prepared by soap-free emulsion polymerization such as polymethylmethacrylate particles and polystyrene particles. Among these, polymer particles with a relatively narrow particle diameter distribution are preferable, and polymer particles with a volume average particle diameter of 0.01 μm to 1 μm are more preferable.

X. Charge Control Agent

The toner of the invention may include charge control agent if necessary. As the charge control agent, the any known charge control agents may be used, and examples thereof include a nigrosine dye, a triphenylmethane dye, a chromium-containing metal complex dye, a molybdic acid chelate pigment, a Rhodamine dye, alkoxy amine, quaternary ammonium salt (including fluorine-modified quaternary ammonium salt), alkylamide, phosphorus as an element or a compound, tungsten as an element or a compound, fluorine activator, metal salt of a salicylic acid and metal salt of salicylic acid derivative. Specific examples thereof include BONTRON 03 (nigrosine dye), BONTRON P-51 (quaternary ammonium salt), BONTRON S-34 (metallized azo dye), E-82 (metal complex of oxynaphthoic acid), E-84 (metal complex of salicylic acid) and E-89 (phenolic condensate), manufactured by Orient Chemical Industries, Ltd.; TP-302 and TP-415 (molybdenum complex of quaternary ammonium salt) manufactured by Hodogaya Chemical Co., LTD.; COPY CHARGE PSY VP2038 (quaternary ammonium salt), COPY BLUE PR (triphenyl methane derivative), COPY CHARGE NEG VP2036 and NX VP434 (quaternary ammonium salt), manufactured by Hoechst AG; LRA-901 and LR-147 (boron complex), manufactured by Japan Carlit Co., Ltd.; copper phthalocyanine, perylene, quinacridone, azo pigments and polymer compounds having a functional group such as sulfonate group, carboxyl group and quaternary ammonium salt group.

X-1 Amount of Charge Control Agent

The amount of the charge control agent varies depending on the method for producing the toner including the type of the binder resin, the presence or absence of the optionally used additives and the dispersion method, and it may not be unambiguously determined. It is, however, based on 100 parts by mass of the binder resin, preferably 0.1 parts by mass to 10 parts by mass, more preferably 0.2 parts by mass to 5 parts by mass is used. The amount of the charge control agent of more than 10 parts by mass increases the charge property of the toner excessively and weakens the effect of the charge control agent. The increase of the electrostatic attraction with a developing roller causes the decrease in the flowability of the developer and the image quality. These may be melted and kneaded with a master batch, and a resin, may surely be added to when mixing and dispersing in an organic solvent. Moreover, it may be externally added and mixed by HENSCHEL MIXER.

The average circularity of the toner of the invention is preferably 0.95 to less than 0.99. When the average circularity of the toner is less than 0.95, the shape of the toner varies greatly, thus a photoconductor is easily scarred in part. When the average circularity of the toner is more than 0.99, the shape of the toner becomes sphere, and the toner easily drops out from a sleeve, thus blade cleaning property may be decreased.

The average circularity of the toner can be measured with flow-type particle image analyzer FPIA-2100 by Sysmex Corp. Specifically, the measurement is performed by adding 0.1 ml to 5 ml of alkylbenzene sulfonate as a dispersing agent to 50 ml to 100 ml of 1 mass % aqueous solution of NaCl prepared using primary sodium chloride, followed by passing through 0.45 μm filter, and then 1 mg to 10 mg of a sample is added. This is subjected to dispersion treatment for approximately 1 minute using an ultrasonic disperser, and the dispersion adjusted to a particle concentration of 5,000/μl to 15,000/μl is measured. A diameter of a circle having the same area as the area of two-dimensional image photographed with a CCD camera is defined to be a circle-equivalent diameter and based on preciseness of the CCD pixel, the circle-equivalent diameter of 0.6 μm or more is an effective value. The average circularity is obtained by calculating the degree of circularity of each particle, and the calculated degrees of circularity of each particle are added and then divided by total numbers of particles. The average circularity of each particle can be calculated by dividing the circumference of an equivalent circle having the same area as the projected area of the shape of toner particle by the circumference of the projected image of the shape of toner particle.

The volume average particle diameter of the toner of the invention is preferably 4 μm to less than 8 μm. When the volume average particle diameter of the toner is less than 4 μm, it is not preferable as the productivity of the toner is adversely affected and flowability is significantly decreased. When the volume average particle diameter of the toner is more than 8 μm, it is not preferable as the image quality may be decreased sometimes. The volume average particle diameter of the toner can be measured, for example, by Coulter Multisizer IIe. The diameter of the aperture is 100 μm.

The toner produced according to the above description may be used as a magnetic one-component toner which does not use a magnetic carrier, or a nonmagnetic toner.

The toner of the invention may be used for a two-component developer by mixing with the magnetic carrier. The magnetic carrier may be preferably a ferrite which contains a divalent metal such as iron, magnetite, Mn, Zn, and Cu, and has the volume average particle diameter of 20 μm to 100 μm. When the volume average particle diameter is less than 20 μm, the carrier adhesion to the photoconductor is likely to occur when developing. When the volume average particle diameter is more than 100 μm, the mixing property with the toner is not good, and the charging amount of the toner is insufficient, thus the charge failure is likely to occur when using continuously. Zn-containing Cu-ferrite is preferable due to its high saturation magnetization, and may be selected appropriately depending on the process for an image forming apparatus. The resin which coats a magnetic carrier is not limited. Examples thereof include styrene-acrylic resin, fluorine-containing resin, and olefin resin. The method for producing the resin is, for example, the method in which a coating resin is dissolved in a solvent, and then it may be coated on a core with spraying in a fluidized bed, and the method in which resin particles are adhered to a core particle electrostatically, and then coat thereon by heating and melting. The thickness of the resin to be coated is 0.05 μm to 10 μm, and preferably 0.3 μm to 4 μm.

Figure 2:
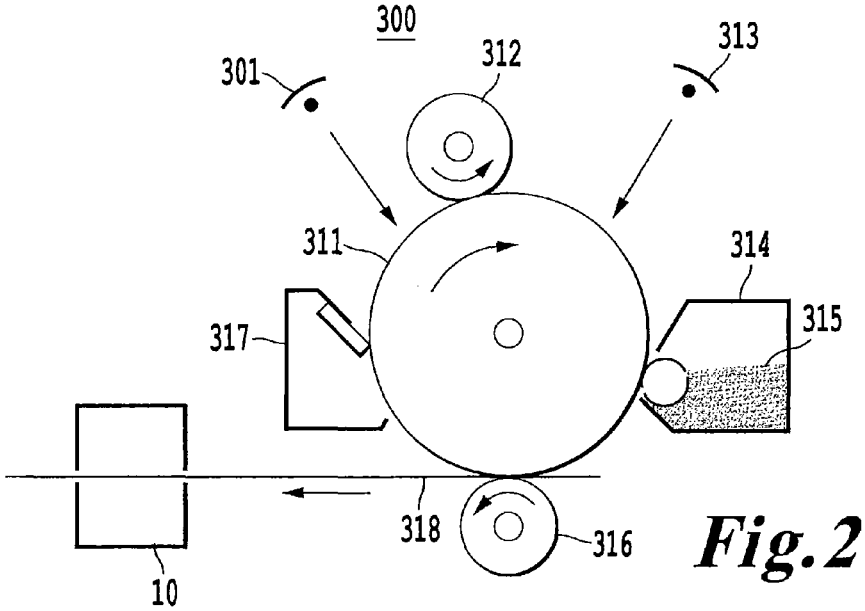
FIG. 2 shows an example of an image forming apparatus of the present invention.
Figure 3:
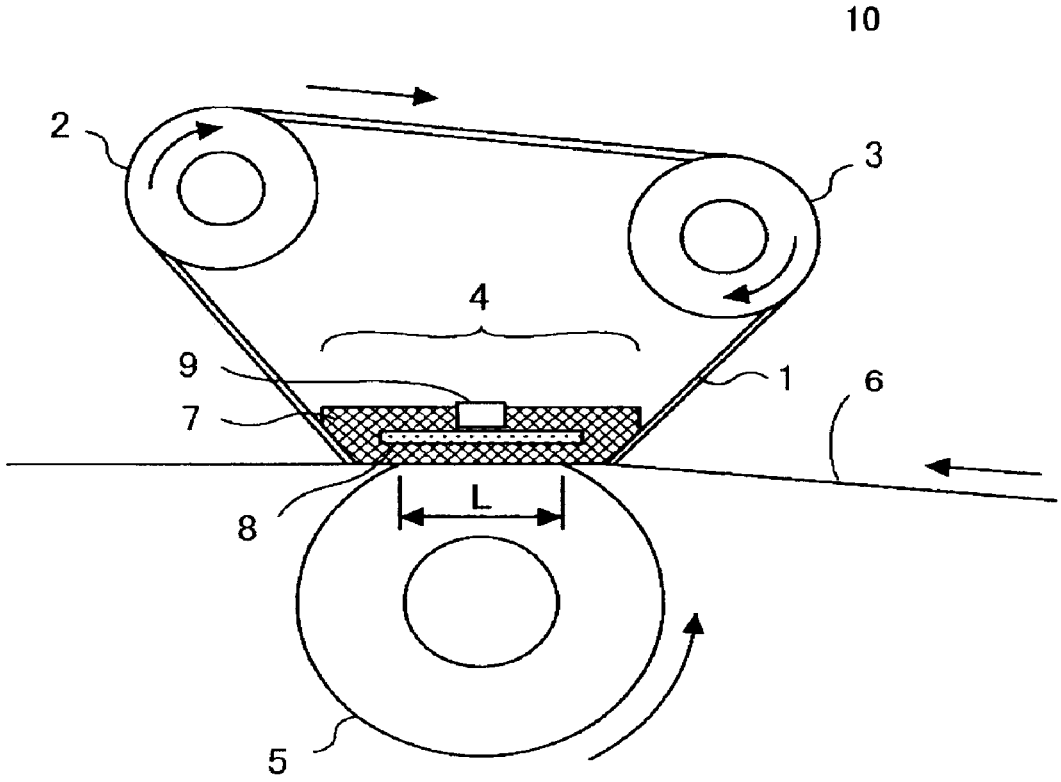
FIG. 3 shows an example of a fixing unit of the present invention.

An image-forming apparatus 300 of the present invention shown in FIG. 2 contains a photoconductor 311, a charging unit 312 configured to charge the photoconductor 311, an exposing unit 313 configured to expose the photoconductor 311 to form a latent electrostatic image, a developing unit 314 configured to develop the latent electrostatic image using a toner 315 to form a toner image, to which the toner 315 is supplied, a transferring unit 316 configured to transfer the toner image bared on the photoconductor 311 to a recording medium 318, and a fixing unit 10 configured to fix the toner image on the recording medium 318, wherein the toner 315 is the toner of the invention.

Particularly, the image forming apparatus heats and melts a toner image on the recording medium by passing between two rollers so as to fix using the toner of the invention, and preferably to fix with low contact pressure (load of roller/contact area) applied between two rollers.

A fixing unit in the image forming apparatus of the invention contains at least a fixing roller, a pressurizing roller, a metal cylinder, an offset preventing layer, a heating lamp, a toner image, and a support (a transfer paper such as a paper).

In a fixing unit which is used in the image forming apparatus of the invention, as the contact pressure (load of roller/contact area) applied between two rollers is low, the toner image on the recording medium is not pressed, thus a high resolution image can be output.

The image forming apparatus of the invention uses the toner of the invention and contains a fixing device containing a heating element equipped with a heat generator, a film configured to contact with the heating element, a pressing member configured to contact pressingly with the heating element via the film, wherein a recording medium on which an unfixed image is formed is passed between the film and the pressing member to heat and fix the image. The image forming apparatus may be an image forming apparatus capable of forming a multicolor image.

With reference to FIG. 2, a fixing unit 10 of the invention is a SURF (surface rapid fusing) fixing device in which the fixing is carried out by rotating a fixing film 1. Specifically, the fixing film 1 is a heat-resistant film in a form of an endless belt, and the fixing film is spanned around a driving roller 2 which is a supportive rotator of the fixing film, a driven roller 3, and a heating element 4 which is fixedly supported by a heater supporter located between and below both of the driving roller 2 and driven roller 3.

The driven roller 3 also works as a tension roller of the fixing film 1. The fixing film 1 is rotationally driven in a clockwise rotating direction according to the driving roller 2. This rotational speed of the fixing film 1 is adjusted to be equivalent to the speed of a recording medium 6 at a fixing nip region L where a pressurizing roller 5 and the fixing film 1 come in contact each other.

The pressurizing roller 5 has a rubber elastic layer having an excellent releasing ability, such as a silicone rubber. The pressurizing roller 5 rotates in a counterclockwise direction so as to adjust a contact pressure at 4 kg to 10 kg with respect to the fixing nip region L.

The fixing film 1 preferably has excellent heat resistance, releasing ability and wearing resistance. The thickness thereof is generally 100 μm or less, and preferably 40 μm or less. Examples of the fixing films are single or multi layered film of heat-resistant resins such as polyimide, poly(ether imide), PES (poly(ether sulfide)), and PFA (tetra fluoro ethylene-perfluoro alkylvinyl ether copolymer). Specific examples may be a 20 μm-thick film in which a 10 μm-thick releasing coat layer formed of an electroconducting agent-added fluoride resin such as PTFE (polytetrafluoroethylene resin), PFA, or an elastic layer such as a fluorocarbon rubber or a silicone rubber is disposed at least on the side in contact with an image.

The heating element 4 of the fixing unit 10 contains the flat substrate 7 and a fixing heater 8. The flat substrate 7 is formed of a material having high thermal conductivity and high electric resistance, such as alumina. On the surface of the heating element where the fixing film 1 is in contact with, the fixing heater 8 formed of a resistant heating element is disposed so that the longer side of the fixing heater 8 lies along the traveling direction of the fixing film 1. Such fixing heater 8 is, for example, screen printed with electric resistant material such as Ag/Pd or Ta2N in liner stripe or band stripe. Moreover, electrodes (not shown) are disposed at both ends of the fixing heater 8 so that the resistant heating element generates a heat by energizing between the electrodes. Further, on a side of the flat substrate 7 to the fixing heater 8, a fixing thermal sensor 9 formed of thermistor is disposed.

Thermal information of the flat substrate 7 is detected by the fixing thermal sensor 9 and is sent to a controller (not shown) so that quantity of electricity supplied to the fixing heater 8 is controlled and thus the heating element 4 is controlled at a predetermined temperature.

The image forming apparatus of the present invention may be an oilless fixing unit which does not require oil coating on the fixing member.

Figure 4:
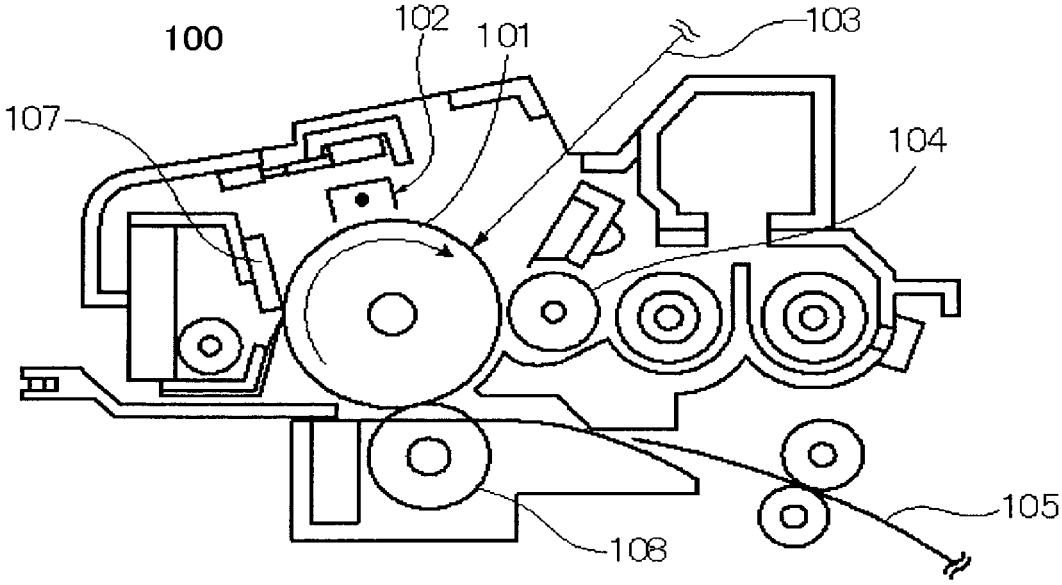
FIG. 4 shows an example of a schematic view of a process cartridge which is mounted in the image forming apparatus of the present invention.

With reference to FIG. 4, a process cartridge 100 of the invention uses the toner of the invention and contains a photoconductor 101 and at least one selected from a charging unit 102, an exposing unit 103, a developing unit 104, and a cleaning unit 107 integrally, which is detachably attached to an image-forming apparatus.

The process cartridge is configured to contain preferably a photoconductor, a charging unit, an exposing unit, a developing unit, and a cleaning unit.

In the present invention, the process cartridge may be configured to contain more than one unit among the components containing the photoconductor, the charging unit, the exposing unit, the developing unit, and the cleaning unit integrally, which is detachably attached to an image forming apparatus such as a copier or a printer.

In the image forming apparatus containing the process cartridge of the invention, the photoconductor is rotationally driven at a predetermined circumferential speed. The photoconductor is charged uniformly with positive or negative predetermined potential by the charging unit in the rotating process, and then exposed to an image exposure light from an image exposing unit such as a slit exposure and laser beam scanning exposure, and thus latent electrostatic images are sequentially formed on the surface of the photoconductor. Thus formed latent electrostatic image is developed by a toner with a developing unit, and the developed toner image is sequentially transferred on a recording medium (including an intermediate transferring member) by the transferring unit, which is fed from a paper-feeding part between the photoconductor and the transferring unit at the same timing to the rotation of the photoconductor. The recording medium having the transferred image is separated from the surface of the photoconductor, introduced to an image fixing unit, and the image is fixed, and printed out as a copy to the outside of the apparatus. After transferring the image, the cleaning unit removes the residual toner on the surface of the photoconductor so as to clean the surface. Thereafter, the photoconductor is further discharged, and then is used for forming an image repeatedly.

In Examples below, the production of the toner of the invention will be explained, the parameters of the invention expressed by the formulae (1) to (5), and the conditions in which the exposure of the wax on the toner surface is small, and the wax exudation affected by thermal history are preferably achieved by aqueous granulation.

In the method for granulating a toner by dispersing an oil phase or a primary particle of the toner composition in an aqueous medium, the distribution state of each material inside of the toner is influenced by the polarity of the aqueous medium, the polarity of each material of the toner composition, and a solvent or monomer forming the oil phase.

For example, when the binder resin and the releasing agent are compared, the releasing agent frequently has a lower polarity. The distribution changes depending on kinds of the solvents and monomers which form the oil phase, generally, the material having a polarity close to the aqueous medium tends to be unevenly distributed relatively near the surface of the toner particle. Therefore, when the toner is selected, in which the binder resin has a higher polarity, and the wax has a lower polarity, the wax tends to be unevenly distributed near the center of the toner particles, or included in the binder resin.

As the toner frequently has the above-mentioned properties and tendencies, the dispersion state of the wax defined in the invention can be achieved by selecting appropriately the properties, for example, a polarity, an effect of substituent group, of the binder resin and the releasing agent.

In the case of the binder resin, a key element which influences on the polarity is acid value or hydroxyl value. The affinity to the aqueous medium and the wax may be determined by selecting the acid value or hydroxyl value.

On the other hand, the wax frequently has a lower polarity compared to the binder resin. In the binder resin, the dispersion state of the wax is preferably formed with the wax dispersing agent which is mixed to improve the dispersibility and affinity to the binder resin, thus, in the case of the wax, the dispersibility to the binder resin is influenced by the kinds and amount of the wax dispersing agent as well as the polarity of the wax. Therefore, the state of a wax domain included in the binder resin can be formed by changing appropriately the kinds of the wax, and the kinds and amounts of the wax dispersing agent. This enables to form the dispersion state of the wax inside of the toner, in which the amount of the wax component exposing on the toner surface is smaller, and the wax exudation from the toner surface is caused by thermal history.

For example, to increase the amount of the wax contained inside, the amount of the wax dispersing agent may be increased, the acid value of the binder resin may be increased, and the polarity of the wax may be decreased.

In the case of the producing method, in which primary particles of the toner composition are aggregated to form a toner particle, for example, emulsification aggregation method, the increase of the amount of the wax contained inside is easily attained by decreasing the amount of the primary particles containing the wax in the outermost surface layer by performing the aggregation in an other step, and preparing the primary particle, in which a primary particle of wax is coated with the binder resin before the aggregation.

EXAMPLES

Hereinafter, with referring to Examples and Comparative Examples, the invention will be explained in detail and the following Examples and Comparative Examples should not be construed as limiting the scope of this invention. In Examples and Comparative Examples, all part(s) and percentage(s) (%) are expressed by mass-basis unless indicated otherwise.

Example 1

Synthesis of Low-Molecular Polyester

In a reaction vessel equipped with a cooling tube, an agitator, and a nitrogen introduction tube, 220 parts of bisphenol A ethylene oxide 2 mole adduct, 561 parts of bisphenol A propylene oxide 3 mole adduct, 218 parts of terephthalic acid, 48 parts of adipic acid and 2 parts of dibutyl tin oxide were charged and reacted at a normal pressure and a temperature of 230° C. for 8 hours. After it was further reacted at a reduced pressure of 10 mmHg to 15 mmHg for 5 hours, 45 parts of trimellitic anhydride was added to the reaction vessel. The mixture was reacted at a normal pressure and a temperature of 180° C. for 2 hours to obtain "Low-Molecular Polyester 1". "Low-Molecular Polyester 1" had a number-average molecular mass of 2,500, a mass-average molecular mass of 6,700, a glass transition temperature (Tg) of 43° C. and an acid value of 25 mg KOH/g.

Synthesis of Prepolymer

In a reaction vessel equipped with a cooling tube, an agitator, and a nitrogen introduction tube, 682 parts of bisphenol A ethylene oxide 2 mole adduct, 81 parts of bisphenol A propylene oxide 2 mole adduct, 283 parts of terephthalic acid, 22 parts of trimellitic anhydride and 2 parts of dibutyl tin oxide were charged and reacted at a normal pressure and a temperature of 230° C. for 8 hours. It was further reacted at a reduced pressure of 10 mmHg to 15 mmHg for 5 hours to obtain "Intermediate Polyester 1". "Intermediate Polyester 1" had a number average molecular mass of 2,100, a mass average molecular mass of 9,500, a glass transition temperature (Tg) of 55° C., an acid value of 0.5 mg KOH/g and a hydroxyl value of 49 mg KOH/g.

Next, in a reaction vessel equipped with a cooling tube, an agitator, and a nitrogen introduction tube, 411 parts of "Intermediate Polyester 1", 89 parts of isophorone diiocyanate and 500 parts of ethyl acetate were charged and reacted at a temperature of 100° C. for 5 hours to obtain "Prepolymer 1". "Prepolymer 1" had a free isocyanate content of 1.53% by mass.

Synthesis of Master Batch 40 parts of Carbon black (REGAL™ 400R by Cabot corporation), 60 parts of a polyester resin as a binder resin (RS-801 by Sanyo Chemical Industries, Ltd., acid value of 10, Mm of 20,000, Tg of 64° C.), and 30 parts of water were mixed in HENSCHEL MIXER to obtain a mixture of a pigment aggregate in which water permeated. After it was kneaded using a two-roller mill at a roller surface temperature of 130° C. for 45 minutes, and then the mixture was milled to be 1 mmϕ with a pulverizer to obtain "Master Batch 1".

Preparation of Dispersion of Pigment and Wax (Oil Phase)

In a vessel with an agitator and a thermometer, 378 parts of "Low-Molecular Polyester 1", 127 parts of paraffin wax, 127 parts of a styrene prepolymer as a wax dispersing agent (Tg of 72° C., number average molecular mass of 7,100) and 947 parts of ethyl acetate were charged. After it was heated up to 80° C. while being agitated and maintained at 80° C. for 5 hours, the mixture was cooled down to 30° C. in one hour. Next, 500 parts of "Master Batch 1" and 500 parts of ethyl acetate were charged in the vessel, which was mixed for one hour to obtain "Raw Material Solution 1".

In a vessel 1,324 parts of "Raw Material Solution 1" was transferred, and the carbon black and the wax were dispersed in three passes using a bead mill, manufactured by Ultraviscomill by Aimex Co., Ltd. Here, the bead mill was filled with 0.5-mm zirconia beads at 80% by volume, and in each passes "Raw Material Solution 1" was introduced in the bead bill at a liquid feeding rate of 1 kg/hr, and was dispersed at a disk circumferential velocity of 6 m/sec. Next, 1,324 parts of 65% ethyl acetate solution of "Low-Molecular Polyester 1" was added, and the mixture was dispersed in one pass using the bead mill under the same conditions mentioned above to obtain "Pigment-Wax Dispersion 1". "Pigment-Wax Dispersion 1" was prepared by adding ethyl acetate to be a solid concentration (130° C., 30 minutes) of 50%.

Preparation of Aqueous Medium 953 parts of water, 88 parts of a 25 mass % aqueous dispersion of vinyl resin (styrene-methacrylic acid-sodium salt of butyl acrylate-methacrylic acid ethylene oxide adduct sulfate ester copolymer), 90 parts of a 48.5 mass % aqueous solution of sodium dodecyldiphenyl ether disulfonate (ELEMINOL MON-7, manufactured by Sanyo Chemical Industries, Ltd.), 113 parts of ethyl acetate, and 11.2 parts of potassium persulfate as a radical generator were mixed and stirred to obtain a milky white liquid. This was hereinafter referred to as "Aqueous Phase 1".

Emulsification

In a vessel, 976 parts of "Pigment-Wax Dispersion 1", and 6.0 parts of isophoronediamine as amines were charged and mixed by means of T.K. HOMO MIXER manufactured by Tokushu Kika Kogyo Co., Ltd. at 5,000 rpm for 1 minute. After 137 parts of "Prepolymer 1" was added in the vessel and mixed by means of T.K. HOMO MIXER manufactured by Tokushu Kika Kogyo Co., Ltd. at 5,000 rpm for 1 minute, 1,200 parts of "Aqueous Phase 1" was added to the vessel, and the mixture was mixed by means of T.K. HOMO MIXER at 13,000 rpm for 15 minutes to obtain "Emulsified Slurry 1".

Desolvation

In a vessel equipped with an agitator and a thermometer, "Emulsified Slurry 1" was introduced and desolvated at 30° C. for 8 hours. Then, it was aged at 60° C. for 10 hours to obtain "Dispersed Slurry 1".

Washing and Drying

After 100 parts of "Dispersed Slurry 1" was filtered under a reduced pressure:

(1) 100 parts of ion-exchanged water was added to the filter cake, mixed using T.K. HOMO MIXER at 12,000 rpm for 10 minutes, and then filtered;

(2) 900 parts of ion-exchanged water was added to the filter cake of (1), mixed using T.K. HOMO MIXER at 12,000 rpm for 30 minutes while applying ultrasonic vibrations and then filtered under a reduced pressure. This operation was repeated until the conductivity of the slurry liquid became 10 μC/cm or less.

(3) 10% hydrochloric acid was added to the slurry liquid of (2) to be pH of 4, agitated by means of Three-One Motor for 30 minutes, and then filtered; and (4) 100 parts of ion-exchanged water was added to the filter cake of (3), mixed by means of T.K. HOMO MIXER at 12,000 rpm for 10 minutes and then filtered. This operation was repeated until the conductivity of the slurry liquid became 10 μC/cm or less to obtain "Filter Cake 1".

"Filter Cake 1" was dried at 45° C. for 48 hours in a circulating air dryer, and then, it was passed through a sieve of 75 μm mesh to obtain "Toner Base Body 1". "Toner Base Body 1" had the volume average particle diameter (Dv) of 5.6 μm, the number average particle diameter (Dp) of 5.0 μm, the ratio of Dv to Dp (Dv/Dp) of 1.12, and the average circularity of 0.97. Then, 0.5 parts of hydrophobic silica and 0.5 parts of hydrophobized titanium oxide were added and mixed to 100 parts of "Toner Base Body" in HENSCHEL MIXER to obtain a developer.

The toner of each Examples and Comparative Examples was evaluated in terms of sticking on a developing control blade, and fixing property, and the results therefrom are summarized in Table 1.

In Examples 2 to 10, and Comparative Examples 1 to 3, the toner was prepared in the same way as Example 1, except that the kind and amount of the wax, and the amount of the wax dispersing agent in the preparation of a dispersion of a pigment and a wax (oil phase) in Example 1 were changed to as in Table 1.

The toner prepared in Examples 1 to 10, and Comparative Examples 1 to 3 were analyzed and evaluated as follows.

Evaluation of Sticking on Developing Control Blade

The toner treated with the external additive (developer) was supplied to an Epson LP-1500C black toner cartridge, and the sticking on the developing control blade after the running test of 800 white sheets was visually observed. Evaluation criteria are:

A: No sticking

B: Small amount of sticking and no uneven development

C: Sticking outstands

Evaluation of Fixing and Separating

A 36 mm-width solid band image (applied amount of 9 g/m$^2$) was printed on the front edge in 3 mm of vertically fed A4-size sheet using the toner treated with the external additive (developer) by Ricoh IPSiO CX2500 to prepare an unfixed image. The unfixed image was fixed with a fixing device mentioned below at the fixing temperature of every 10° C. in the range from 130° C. to 190° C. to obtain a range of separable/non-offset temperature. The temperature range was the range of fixing temperature in which a sheet could be separated well from a heating roller, no offset phenomenon occurred, and the image did not peel easily. A paper of 45 g/m$^2$, and short grain was vertically fed, which is disadvantageous for a separating ability. The peripheral velocity of the fixing device was 120 mm/sec.

The fixing device was the one utilizing soft rollers each having a surface layer made of fluorine-based material. Specifically, the heating roller had an outer diameter of 40 mm, in which a 1.5 mm-thick elastic layer of a silicon rubber was disposed on an aluminum core, and a PFA (tetrafluoroethylene-perfluoroalkylvinyl ether copolymer) surface layer was disposed on the elastic layer, and a heater was equipped inside of the aluminum core. The pressurizing roller had an outer diameter of 40 mm, in which a 1.5 mm-thick elastic layer of a silicon rubber was disposed on an aluminum core, and a PFA surface layer was disposed on the elastic layer. The paper on which the unfixed image was printed was passed through the fixing device.

Evaluation criteria are:

A: Separable/non-offset temperature range exceeded 50° C.

B: Separable/non-offset temperature range was 30° C. or more to less than 50° C.

C: Separable/non-offset temperature range was less than 30° C.

Evaluation of Fixing Strength

A fixing unit (contact pressure: 0.7×105 Pa·s) was mounted in a copier imagio MF6550 by Ricoh company, Ltd., and the temperature of the heater was changed and an image was copied to obtain a fixed image. A mending tape (by 3M) was applied and adhered on the image after fixing, and a certain pressure was applied thereon, and followed by peeling slowly. The image densities before the application of the tape, and after peeling the tape were measured by a Macbeth densitometer, and the fixing rate was calculated by the following formula.

Fixing rate (%)=the image density after peeling the tape/the image density before taping×100.

The temperature of the fixing roller was gradually cooled and the fixing temperature was determined as a temperature when the lo fixing rate became 80% or less. The result of the evaluation was rated with the following 3 grades.

Evaluation criteria are:

A: Fixing temperature of less than 130° C.

B: Fixing temperature of 130° C. or more to less than 150° C.

C: Fixing temperature of 150° C. or more

TABLE 1

| | Wax | | Dispersing Agent | | | | | | | |
|---|---|---|---|---|---|---|---|---|---|---|
| | | Amount (toner solid content | Amount (wax solid content | Physical Properties | | | | Evaluation | | |
| | | | | | | | | | Fixing | |
| | Kind | mass %) | mass %) | Iwax (s) | Iwax (t) | T½ | ΔH | Sticking | Strength | Separation |
| Example 1 | Paraffin | 4 | 100 | 0.0558 | 0.259 | 124.8 | 5.21 | A | A | A |
| Example 2 | Paraffin | 4 | 60 | 0.0850 | 0.2493 | 116.2 | 6.37 | A | A | A |
| Example 3 | Paraffin | 5 | 100 | 0.0751 | 0.2815 | 124.5 | 6.71 | A | A | A |
| Example 4 | Paraffin | 6 | 100 | 0.0907 | 0.375 | 124.8 | 7.01 | A | A | A |
| Example 5 | Paraffin | 5.5 | 100 | 0.0809 | 0.3285 | 123.3 | 5.64 | A | A | A |
| Example 6 | Ester/Carnauba = 1:1 | 2 | 60 | 0.1755 | 0.2713 | 123.4 | 5.5 | B | A | A |
| Example 7 | Ester/Carnauba = 1:1 | 2 | 20 | 0.1912 | 0.3684 | 126.1 | 2.5 | B | A | A |
| Example 8 | Ester/Carnauba = 1:1 | 3 | 20 | 0.2384 | 0.3873 | 125.3 | 2.9 | B | A | A |
| Example 9 | Paraffin/Carnauba = 1:1 | 4 | 20 | 0.1326 | 0.3247 | 119.7 | 4.64 | B | A | A |
| Example 10 | Paraffin/Carnauba = 1:1 | 4 | 100 | 0.1043 | 0.2197 | 118.8 | 3.57 | A | A | A |
| Comparative Example 1 | Paraffin | 8 | 100 | 0.1152 | 0.5273 | 121.0 | 9.57 | A | C | A |
| Comparative Example 2 | Paraffin/Carnauba = 1:1 | 8 | 20 | 0.2811 | — | 129.1 | 12.16 | C | A | A |
| Comparative Example 3 | Paraffin | 2 | 100 | 0.0275 | 0.1389 | 132.6 | 6.66 | A | A | C |

Melting points
Paraffin Wax: 76° C.
Ester Wax: 82° C.
Carnauba Wax: 83° C.

The values of Iwax (s), and Iwax (t) in Examples 1 to 10 and Comparative Examples 1 to 3 were plotted in FIG. 1. In the graph of FIG. 1, "●" shows the values of Iwax (s) and Iwax (t) in Examples and "x" shows the values of Iwax (s) and Iwax (t) in Comparative Examples. "■" in the graph is plotted on the basis of the value of Iwax (s) in each Example and Comparative Example, and the value of Iwax (t) calculated from Formula (1). If "●" or "x" is plotted above the corresponding "■", the condition of Formula (1) is satisfied. For example, the leftmost "■" is the plot corresponding to Formula (1) in Comparative Example 3. "x" of Comparative Example 3 is plotted below "■". The rightmost "x" is the plot corresponding to Formula (1) in Comparative Example 2, in which Iwax (t) is not measured. "x" plotted above the value of Formula (3) shows Iwax (s), and Iwax (t) in Comparative Example 1.

It can be seen that "●" in Examples 1 to 10 are plotted in the area where the values of Formulae (1), (2), (3), and (4) are satisfied.

Thus, it is apparent from Examples 1 to 10 in Table 1, when Iwax (s) which is the value measured by FTIR-ATR Spectroscopy before heating a mirror-surfaced pellet formed by compressing and molding the toner, and Iwax (t) which is the value measured by FTIR-ATR Spectroscopy after heating the pellet at the surface temperature of 130° C. for 1 minute satisfy Formulae (1), (2), (3), and (4), and the quantity of heat ΔH associated with melting wax in the toner measured by a differential scanning calorimeter (DSC) is expressed by Formula (5), the toner containing at least a colorant, a wax, and a binder resin, which can control the dispersion state of the wax near the toner surface to suppress sticking and be excellent in fixing property can be provided, and also a high quality image can be provided.

Therefore, the method for forming the image of the invention is not limited as long as the toner which satisfies the condition of the toner as mentioned above is used. The toner of the invention is preferably used in, for example, an image forming apparatus using oilless fixation such as a printer, a copier, and a facsimile.

The preferred embodiment of the present invention has been exemplified, however, the present invention will not be limited to the specific embodiments described herein, and the invention can be varied and modified within the scope of the invention described in the scope of claims.

What is claimed is:

1. A toner for developing a latent electrostatic image comprising:

a colorant, a wax, and a binder resin, wherein Iwax (s) which is a value measured by FTIR-ATR Spectroscopy before heating a mirror-surfaced pellet formed by compressing and molding the toner, and Iwax (t) which is a value measured by FTIR-ATR Spectroscopy after heating the pellet at a surface temperature thereof of 130° C. for 1 minute satisfy Formulae (1), (2), (3), and (4), $$Iwax\ (t) \geqq 0.2*100/[T\tfrac{1}{2}(^\circ\ C.)] \qquad \text{Formula (1)}$$

$$Iwax\ (s) \leqq 0.26 \qquad \text{Formula (2)}$$

$$Iwax\ (t) \leqq 0.50 \qquad \text{Formula (3)}$$

$$Iwax\ (t) > Iwax\ (s) \qquad \text{Formula (4)}$$

wherein Iwax (s) represents a value of before heating the pellet, which is obtained by a formula: absorbance derived from the wax (2850 $cm^{-1}$)/absorbance derived from the binder resin (828 $cm^{-1}$), and Iwax (t) represents a value of after heating the pellet at a surface temperature thereof of 130° C. for 1 minute, which is obtained by a formula: absorbance derived from the wax (2850 $cm^{-1}$)/absorbance derived from the binder resin (828 $cm^{-1}$).

2. The toner for developing a latent electrostatic image according to claim 1, wherein a quantity of heat ΔH associated with melting the wax in the toner measured by a differential scanning calorimeter (DSC) is expressed by Formula (5), $$3.0\ mJ/mg \leqq \Delta H \leqq 14.0\ mJ/mg \qquad \text{Formula (5).}$$

3. The toner for developing a latent electrostatic image according to claim 1, wherein the binder resin is a polyester resin having a glass transition temperature of 40° C. to 75° C.

4. The toner for developing a latent electrostatic image according to claim 3, wherein the polyester resin comprises a polyester resin which is elongated by a urethane bonding and/or a urea bonding.

5. The toner for developing a latent electrostatic image according to claim 3, wherein the polyester resin comprises a modified polyester resin formed by a reaction between a polyester prepolymer having an isocyanate group at both or either terminals thereof, and amines.

6. The toner for developing a latent electrostatic image according to claim 1, wherein the toner has a circularity of 0.95 to less than 0.99, and a volume-average particle diameter of 4 μm to less than 8 μm.

7. The toner for developing a latent electrostatic image according to claim 1, wherein the toner is obtained by forming toner particles in an aqueous medium, and removing an organic solvent from the toner particles.

8. The toner for developing a latent electrostatic image according to claim 1, wherein the toner is obtained by forming toner particles in an aqueous medium, washing the toner particles in an aqueous medium for washing, and drying the toner particles.

9. The toner for developing a latent electrostatic image according to claim 1, wherein the wax comprises at least one selected from a paraffin wax, synthetic ester, polyolefin, a carnauba wax and a rice wax.

10. The toner for developing a latent electrostatic image according to claim 1, further comprises a charge control agent.

11. The toner for developing a latent electrostatic image according to claim 1, wherein the toner is a nonmagnetic one-component toner.

* * * * *